US012753583B2

(12) United States Patent
Akiyama et al.

(10) Patent No.: US 12,753,583 B2
(45) Date of Patent: Oct. 6, 2026

(54) WORK SYSTEM

(71) Applicant: KOBELCO CONSTRUCTION MACHINERY CO., LTD., Hiroshima (JP)

(72) Inventors: Masaki Akiyama, Hiroshima (JP); Daisuke Noda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 113 days.

(21) Appl. No.: 18/707,791

(22) PCT Filed: Oct. 28, 2022

(86) PCT No.: PCT/JP2022/040306
§ 371 (c)(1),
(2) Date: May 6, 2024

(87) PCT Pub. No.: WO2023/090121
PCT Pub. Date: May 25, 2023

(65) Prior Publication Data

US 2025/0003199 A1 Jan. 2, 2025

(30) Foreign Application Priority Data

Nov. 17, 2021 (JP) ..... 2021-187336
Nov. 17, 2021 (JP) ..... 2021-187339
Jul. 4, 2022 (JP) ..... 2022-107941

(51) Int. Cl.
*E02F 9/26* (2006.01)
*E02F 3/43* (2006.01)

(52) U.S. Cl.
CPC ..... *E02F 9/262* (2013.01); *E02F 3/434* (2013.01); *E02F 3/437* (2013.01)

(58) Field of Classification Search
CPC ..... E02F 9/262; E02F 3/434; E02F 3/437
(Continued)

(56) References Cited

U.S. PATENT DOCUMENTS 4,909,561 A * 3/1990 Lovaas ..... B60J 7/041 296/100.04
6,363,632 B1 4/2002 Stentz et al.
(Continued)

FOREIGN PATENT DOCUMENTS

CN 111226007 A 6/2020
CN 111819331 A 10/2020
(Continued)

OTHER PUBLICATIONS

Extended European Search Report issued Feb. 6, 2025 in European Patent Application 22896404.6, 7 pages.
(Continued)

*Primary Examiner* — Krishnan Ramesh
(74) *Attorney, Agent, or Firm* — Oblon, McClelland, Maier & Neustadt, L.L.P.

(57) ABSTRACT

A work system is a system for automatically operating a work machine including a work device. The work system includes a controller that controls an operation of the work machine so that a leveling work is performed, the leveling work including a leveling operation in which a work target object that has been loaded into a container by a loading work is leveled using the work device. The controller acquires information regarding at least one of the work target object in the container, the container, the work machine, and the loading work, and determines at least one of a start position of the leveling operation and an end position of the leveling operation by using the information.

7 Claims, 13 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2014/0288771 | A1 | 9/2014 | Li | |
| 2018/0171596 | A1 | 6/2018 | Li | |
| 2020/0199843 | A1 | 6/2020 | Ono | |
| 2020/0277752 | A1* | 9/2020 | Igarashi | E02F 9/262 |
| 2021/0010229 | A1* | 1/2021 | Sano | E02F 9/2292 |
| 2021/0332566 | A1* | 10/2021 | Shintani | E02F 9/261 |
| 2022/0195690 | A1* | 6/2022 | Wu | E02F 3/437 |
| 2025/0129577 | A1* | 4/2025 | Yoshimoto | E02F 9/24 |

FOREIGN PATENT DOCUMENTS

| | | | |
|---|---|---|---|
| CN | 113039326 | A | 6/2021 |
| JP | 11-310389 | A | 11/1999 |
| JP | 2021-025258 | A | 2/2021 |
| WO | 2000-136549 | A | 5/2000 |
| WO | WO 2013/099491 | A1 | 7/2013 |
| WO | WO 2019/049701 | A1 | 3/2019 |
| WO | WO 2021/054436 | A1 | 3/2021 |

OTHER PUBLICATIONS

International Search Report Issued Dec. 27, 2022, in PCT/JP2022/040306, filed on Oct. 28, 2022, 2 pages.
Office Action dated Jun. 6, 2026, issued in corresponding Chinese patent application No. 202280075047.7 (with English translation).

* cited by examiner

WORK SYSTEM

TECHNICAL FIELD

The present invention relates to a work system for causing a work machine to perform work.

BACKGROUND ART

For example, Patent Literature 1 describes that a work machine performs work of leveling a work target object in a container (a cargo bed in Patent Literature 1) by automatic operation (see paragraph [0164], FIG. 11, and the like of Patent Literature 1).

It is desirable to cause the work machine to efficiently perform leveling work by automatic operation.

CITATION LIST

Patent Literature

Patent Literature 1: JP 2021-025258 A

SUMMARY OF INVENTION

Therefore, an object of the present invention is to provide a work system capable of causing a work machine to efficiently perform leveling work by automatic operation.

Provided is a work system for automatically operating a work machine including a work device. The work system includes a controller that controls an operation of the work machine so that a leveling work is performed, the leveling work including a leveling operation in which a work target object that has been loaded into a container by a loading work is leveled using the work device. The controller acquires information regarding at least one of the work target object in the container, the container, the work machine, and the loading work, and determines at least one of a start position of the leveling operation and an end position of the leveling operation by using the information.

The work system can cause a work machine to efficiently perform the leveling work by automatic operation.

DESCRIPTION OF EMBODIMENTS

First Embodiment

A work system 1 according to a first embodiment of the present invention will be described with reference to FIGS. 1 to 7.

Figure 1:
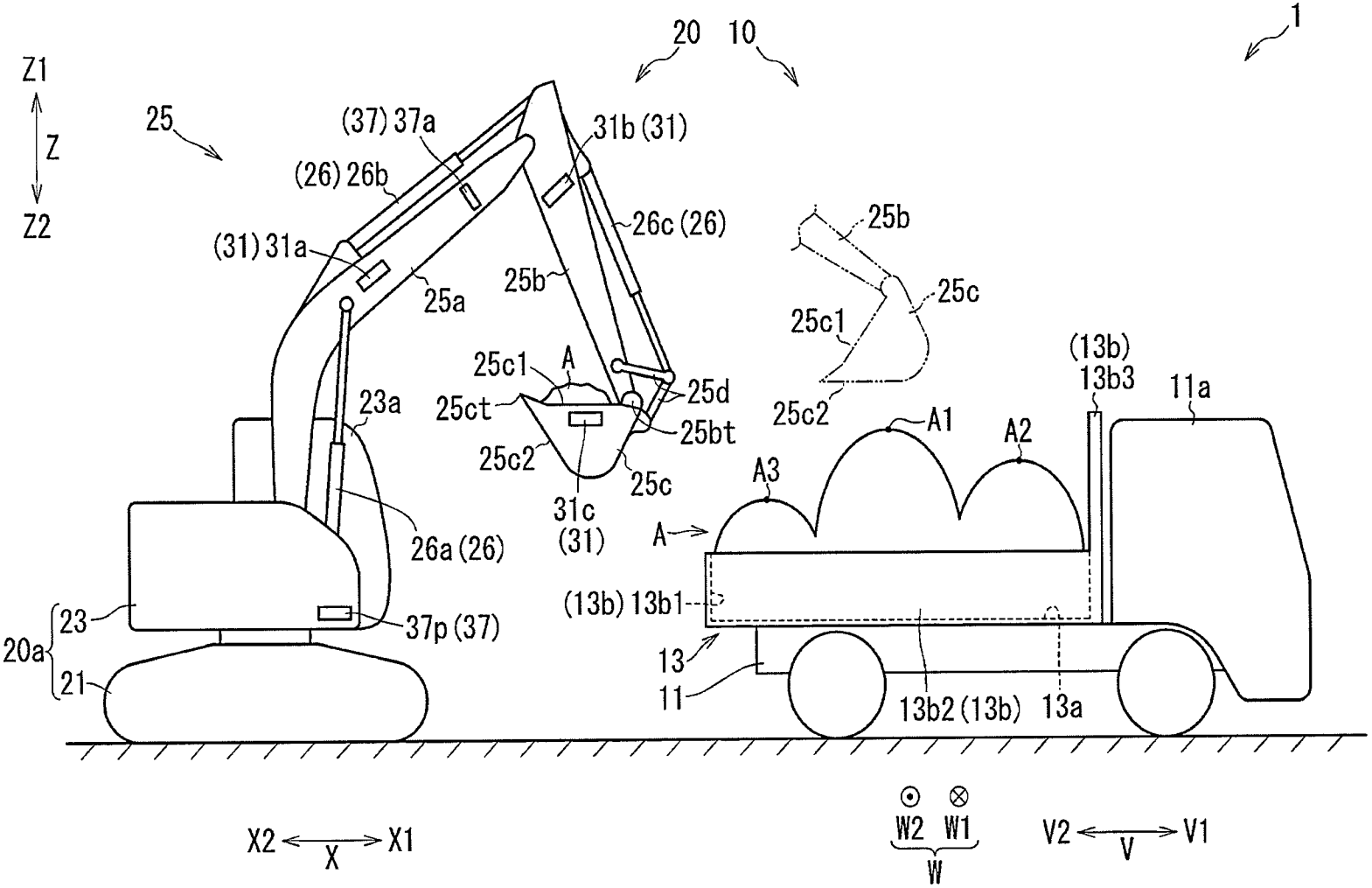
FIG. 1 is a view of a vehicle and a work machine of a work system according to a first embodiment of the present invention as viewed from a side.

As illustrated in FIG. 1, the work system 1 according to the first embodiment is a system that controls an operation of a work machine 20 so that a leveling work is performed on a work target object A loaded into a container 13. The work system 1 includes a vehicle 10, a work machine 20, and a detection unit 30, an operation unit 41, and a controller 50 illustrated in FIG. 3. Note that, at least one of the vehicle 10, the work machine 20, the detection unit 30, and the operation unit 41 may be a component of the work system 1 or may not be a component of the work system 1. That is, the work system 1 is only required to include at least the controller 50.

As illustrated in FIG. 1, the vehicle 10 is a machine (transport vehicle) that transports a transported object (work target object A) stored in the container 13. The vehicle 10 may be, for example, a dump truck. The vehicle 10 includes a vehicle body 11 and the container 13.

The vehicle body 11 supports the container 13. The vehicle body 11 can travel, and may travel with wheels or crawlers. The vehicle body 11 includes a vehicle cab 11*a*.

The container 13 accommodates the work target object A. The container 13 may have, for example, a box shape without a lid. For example, the container 13 may be a cargo bed of the vehicle 10 or may not be a cargo bed of the vehicle 10. The container 13 may be placed on the ground. The container 13 may surround a hole (for example, a soil pit) provided on the ground (side wall). In this case, the container 13 does not have to have a bottom (a portion corresponding to a container floor surface 13*a*). Hereinafter, a case where the container 13 is a cargo bed of the vehicle 10 will be mainly described. The container 13 is arranged behind the vehicle cab 11*a*. The container 13 may be configured to be capable of being displaced with respect to the vehicle body 11, or may be fixed to the vehicle body 11. Hereinafter, a case where the container 13 is arranged in an attitude in which a container wall surface 13*b* of the container 13 stands upright in a vertical direction will be described. The container 13 includes the container floor surface 13*a* and the container wall surface 13*b*.

An upward/downward direction Z is a direction of an arrow indicated by "Z" in FIG. 1, and is a vertical direction or an approximately vertical direction. An upward direction Z1 is a direction of an arrow indicated by "Z1" in FIG. 1, and a downward direction Z2 is a direction of an arrow indicated by "Z2" in FIG. 1. A forward/rearward direction of the container 13 is a direction orthogonal to the upward/downward direction Z, is referred to as a container forward/rearward direction V, and is a direction of an arrow indicated by "V" in FIGS. 1 and 2. A forward direction with respect to the container 13 is referred to as a container forward direction V1, and is a direction of an arrow indicated by "V1" in FIGS. 1 and 2. A rearward direction with respect to the container 13 is referred to as a container rearward direction V2, and is a direction of an arrow indicated by "V2" in FIGS. 1 and 2.

Figure 2:
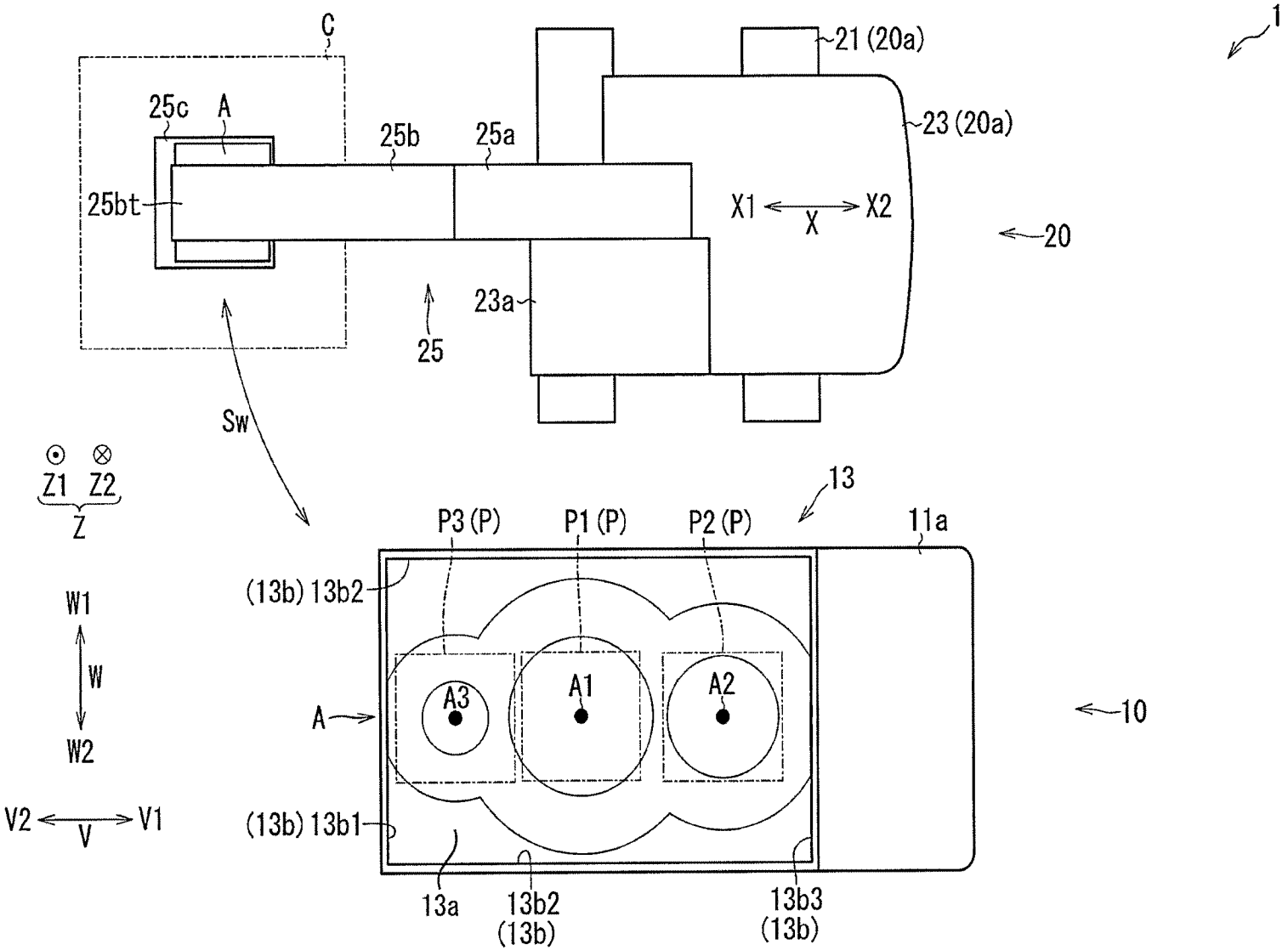
FIG. 2 is a view of a vehicle and a work machine arranged in a layout different from an example illustrated in FIG. 1 as viewed from above.

In a specific example illustrated in FIG. 2, the container forward/rearward direction V is a longitudinal direction of the container 13. For example, as illustrated in FIG. 2, when the shape of the container 13 viewed from above is a rectangle, the container forward/rearward direction V is a direction along a long side of the rectangle. In the case where the container 13 is a cargo bed of the vehicle 10, the container forward direction V1 is a direction from the container 13 toward the vehicle cab 11*a*, and the container rearward direction V2 is a direction from the vehicle cab 11*a* toward the container 13. A direction orthogonal to each of the vertical direction and the container forward/rearward direction V is referred to as a container width direction W, and is a direction indicated by "W" in FIG. 2. A leftward direction with respect to the container 13 is referred to as a container leftward direction W1, and is a direction indicated by "W1" in FIG. 2. A rightward direction with respect to the container 13 is referred to as a container rightward direction W2, and is a direction indicated by "W2" in FIG. 2. Note that the container forward direction V1 and the container rearward direction V2 in the following description may be opposite to each other. The container rightward direction W2 and the container leftward direction W1 in the following description may be opposite to each other.

As illustrated in FIGS. 1 and 2, the container floor surface 13*a* is a bottom surface of the container 13. The container floor surface 13*a* is planar or approximately planar. Each of a tail gate plate surface 13*b*1, a side gate panel surface 13*b*2, and a guard frame surface 13*b*3 described later is similarly planar or approximately planar. The container wall surface 13*b* is provided so as to stand in the upward direction Z1 from the container floor surface 13*a*. The container wall surface 13*b* includes the tail gate plate surface 13*b*1, left and right side gate panel surfaces 13*b*2, and the guard frame surface 13*b*3. The tail gate plate surface 13*b*1 is a surface located at an end portion in the container rearward direction V2 on the container 13, and stands in the upward direction Z1 from an end portion in the container rearward direction V2 on the container floor surface 13*a*. As illustrated in FIG. 2, the left side gate panel surface 13*b*2 is a surface located at an end portion in the container leftward direction W1 on the container 13, and stands in the upward direction Z1 from an end portion in the container leftward direction W1 on the container floor surface 13*a*. The right side gate panel surface 13*b*2 is a surface located at an end portion in the container rightward direction W2 on the container 13, and stands in the upward direction Z1 from an end portion in the container rightward direction W2 on the container floor surface 13*a*. As illustrated in FIG. 1, the guard frame surface 13*b*3 is a surface located at an end portion in the container forward direction V1 on the container 13, and stands in the upward direction Z1 from an end portion in the container forward direction V1 on the container floor surface 13*a*. The guard frame surface 13*b*3 protrudes higher in the upward direction Z1 than the side gate panel surfaces 13*b*2 and protrudes higher in the upward direction Z1 than the tail gate plate surface 13*b*1.

The work machine 20 is a machine that performs work. The work machine 20 is a machine that performs a leveling work to be described later. The work machine 20 may perform a loading work to be described later. The work machine 20 is, for example, a construction machine that performs construction work, and may be, for example, an excavator illustrated in FIG. 1. The work machine 20 is configured to be operable by automatic operation. That is, the work machine 20 is automated so as to operate on the basis of a command input from the controller 50. The work machine 20 may be operable on the basis of an operation by a worker (operator) in a cab 23*a* described later, or may be configured to operate on the basis of a remote operation by an operator at a remote location away from the work machine 20.

Figure 3:
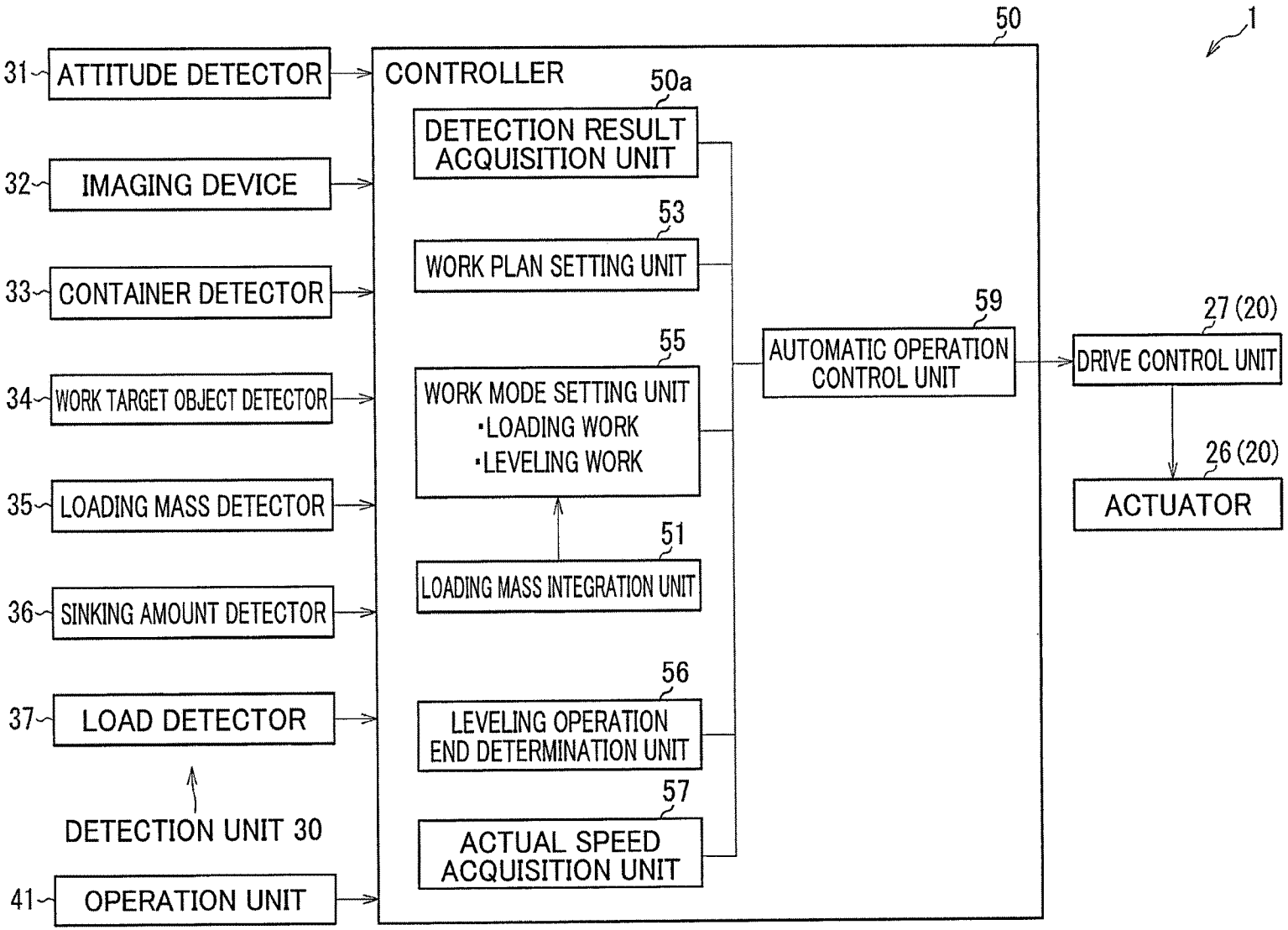
FIG. 3 is a block diagram of the work system according to the first embodiment.

As illustrated in FIG. 1, the work machine 20 includes a work machine body 20*a*, an attachment 25 (work device 25), a plurality of actuators 26, and a drive control unit 27 (see FIG. 3).

The work machine body 20*a* is a main portion of the work machine 20. The work machine body 20*a* includes a lower travelling body 21 and an upper slewing body 23.

The lower travelling body 21 causes the work machine 20 to travel. The lower travelling body 21 may include crawlers or wheels.

The upper slewing body 23 is installed in the lower travelling body 21 so as to be able to slew. The attachment 25 is mounted on the upper slewing body 23. The upper slewing body 23 includes the cab 23*a*. The cab 23*a* is a portion where a worker (operator) can operate the work machine 20.

A direction in which a rotation axis of slewing of the upper slewing body 23 with respect to the lower travelling body 21 extends is the upward/downward direction Z. A forward/rearward direction of the work machine 20 is a direction orthogonal to the upward/downward direction Z, is referred to as a machine forward/rearward direction X, and is a direction of an arrow indicated by "X" in FIGS. 1 and 2. A forward direction with respect to the work machine 20 is referred to as a machine forward direction X1, and is a direction in which the attachment 25 protrudes with respect to the upper slewing body 23 when the work machine 20 is viewed from above as illustrated in FIG. 2. A rearward direction with respect to the work machine 20 is referred to as a machine rearward direction X2, and is a direction opposite to the machine forward direction X1. A direction of slewing of the upper slewing body 23 with respect to the lower travelling body 21 is referred to as a machine slewing direction Sw.

The attachment 25 (work device 25) performs work as illustrated in FIG. 1. The attachment 25 includes a boom 25*a*, an arm 25*b*, a distal end attachment 25*c*, and a link 25*d*. The boom 25*a* is mounted on the upper slewing body 23 so as to be raised and lowered (rotatable up and down). The arm 25*b* is rotatably mounted to the boom 25*a*. A distal end portion of the arm 25*b* is referred to as an arm distal end portion 25*bt*. The distal end attachment 25*c* is used to level the work target object A in the leveling work. In the present embodiment, the distal end attachment 25*c* is a bucket, and may be configured to be able to capture the work target object A in a capturing phase to be described later. The distal end attachment 25*c* constitutes a distal end portion of the attachment 25 and is rotatably attached to the arm 25*b*.

The distal end attachment 25*c* includes an opening 25*c*1 and a leveling surface 25*c*2. The opening 25*c*1 is configured to allow the work target object A to enter and exit. The leveling surface 25*c*2 is configured to be able to level the work target object A. The leveling surface 25*c*2 is planar or approximately planar. For example, the leveling surface 25*c*2 is provided in a portion close to a distal end of the distal end attachment 25*c*. For example, the leveling surface 25*c*2 is provided in a portion between a bottom portion of the distal end attachment 25*c* and a distal end portion of the distal end attachment 25*c* when the opening 25*c*1 of the distal end attachment 25*c* is arranged above the bottom portion of the distal end attachment 25*c* as indicated by a solid line in FIG. 1. The distal end portion of the distal end attachment 25*c* is referred to as a distal end attachment distal end portion 25*ct*. The link 25*d* is a member for rotating the distal end attachment 25*c* with respect to the arm 25*b* by expansion and contraction of a distal end attachment cylinder 26*c* (described later). The link 25*d* is connected to the distal end attachment cylinder 26*c*, the arm 25*b*, and the distal end attachment 25*c*.

The work target object A is an object to be worked on by the work machine 20. The work target object A is leveled by the distal end attachment 25*c* in the leveling work. The work target object A is captured by the distal end attachment 25*c* in a capturing phase to be described later, is released from the distal end attachment 25*c* in a release phase to be described later, and is loaded into the container 13. The work target object A is earthy, granular, chip-like, powdery, massive, or the like. For example, the work target object A may be soil, stone, wood, metal, or waste.

The plurality of actuators 26 actuates the work machine 20. The plurality of actuators 26 includes a boom cylinder 26*a*, an arm cylinder 26*b*, and a distal end attachment cylinder 26*c*. The boom cylinder 26*a* raises and lowers the boom 25*a* with respect to the upper slewing body 23. The boom cylinder 26*a* is, for example, a hydraulic cylinder that expands and contracts by hydraulic pressure. Each of the arm cylinder 26*b* and the distal end attachment cylinder 26*c* is similarly a hydraulic cylinder that expands and contracts by hydraulic pressure. The arm cylinder 26*b* rotates the arm 25*b* with respect to the boom 25*a*. The distal end attachment cylinder 26*c* rotates the distal end attachment 25*c* with respect to the arm 25*b*. Note that the plurality of actuators 26 further includes a slewing motor that causes the upper slewing body 23 to slew with respect to the lower travelling body 21, and a travelling motor that causes the lower travelling body 21 to travel. The slewing motor and the travel motor may be, for example, a hydraulic motor or an electric motor.

The drive control unit 27 controls operation of the plurality of actuators 26. The drive control unit 27 includes a hydraulic circuit that controls the hydraulic actuators 26. In a case where each of the plurality of actuators 26 is an electric actuator, the drive control unit 27 may include an electric circuit that controls the plurality of actuators 26.

The detection unit 30 (see FIG. 3) detects various states in the work system 1. The detection unit 30 outputs a detection value to the controller 50. The detection unit 30 includes an attitude detector 31, an imaging device 32, a container detector 33, a work target object detector 34, a loading mass detector 35, a sinking amount detector 36, and a load detector 37.

The attitude detector 31 detects an attitude of the work machine 20 illustrated in FIG. 1. The attitude detector 31 includes a boom attitude sensor 31*a*, an arm attitude sensor 31*b*, and a distal end attachment attitude sensor 31*c*.

The attitude detector 31 may detect a position and orientation of the work machine 20 with respect to the work site. The attitude detector 31 may detect a position and orientation of a reference portion of the work machine 20 with respect to the work site. The reference portion of the work machine 20 may be, for example, a specific portion of the upper slewing body 23 or the lower travelling body 21, or may be, for example, an attachment portion (boom foot) of the boom 25*a* to the upper slewing body 23. The attitude detector 31 may detect information (angle, angular speed, angular acceleration, or the like) of slewing of the upper slewing body 23 with respect to the lower travelling body 21.

The boom attitude sensor 31*a* detects information (angle, angular speed, angular acceleration, or the like) of the rotation of the boom 25*a* with respect to the upper slewing body 23. The arm attitude sensor 31*b* detects information of the rotation of the arm 25*b* with respect to the boom 25*a*. The distal end attachment attitude sensor 31*c* detects information of the rotation of the distal end attachment 25*c* with respect to the arm 25*b*.

The attitude sensor such as the boom attitude sensor 31*a* included in the attitude detector 31 may be a sensor that detects an angle (for example, a rotary encoder) or a sensor that detects an inclination with respect to a horizontal direction. Each attitude sensor may be a sensor that detects a stroke of a cylinder (for example, boom cylinder 26*a*) that drives the attachment 25. The attitude detector 31 may detect the attitude of the work machine 20 on the basis of at least one of a two-dimensional image and an image (distance image) having distance information (depth information). In this case, at least one of the two-dimensional image and the distance image may be captured by the imaging device 32.

The attitude detector 31 may be mounted on the work machine 20 or may be arranged outside the work machine 20 (for example, at a work site). The detection unit 30, the operation unit 41, and the controller 50 other than the attitude detector 31 illustrated in FIG. 3 may be mounted on the work machine 20 or may be arranged outside the work machine 20.

The imaging device 32 captures an image of an imaging object. The imaging object of the imaging device 32 may be the work machine 20 illustrated in FIG. 1, for example, the attachment 25, and for example, the distal end attachment 25*c*. The imaging object of the imaging device 32 may be the vehicle 10, for example, the container 13. The imaging object of the imaging device 32 may be the work target object A.

The imaging device 32 may detect two-dimensional information (for example, a position and a shape in an image) of the imaging object. The imaging device 32 may include a camera (monocular camera) that detects two-dimensional information. The imaging device 32 may detect three-dimensional information (for example, three-dimensional coordinates or a three-dimensional shape) of the imaging object and may acquire a distance image. The imaging device 32 may include a device that detects three-dimensional information using laser light. The imaging device 32 may include, for example, light detection and ranging (LIDAR), and may include, for example, a time of flight (TOF) sensor. The imaging device 32 may include a device (for example, a millimeter wave radar) that detects three-dimensional information by using radio waves. The imaging device 32 may include a stereo camera. The imaging device 32 may detect three-dimensional information about the imaging object on the basis of the distance image and the two-dimensional image. The detection unit 30 may include a single imaging device 32 or may include a plurality of imaging devices 32. The imaging device 32 may be a device mounted on the work machine 20 or a device (for example, a work site camera) arranged at a work site.

The container detector 33 detects information of the container 13. The container detector 33 may detect the position of the container 13 and may detect the shape of the container 13. The container detector 33 may detect information of the container 13 on the basis of an image of the container 13, and in this case, the container detector 33 may be the imaging device 32. The image of the container 13 may include at least one of a two-dimensional image and a distance image.

The container detector 33 may detect the information of the container 13 on the basis of information of teaching. The detection of the information of the container 13 based on the information of teaching is performed, for example, as follows. A worker (operator) gets aboard the work machine 20 to operate the work machine 20, or the worker remotely operates the work machine 20. For example, the worker operates the work machine 20 to dispose a specific portion (for example, the distal end attachment distal end portion 25*ct*) of the attachment 25 in a specific portion (for example, a corner portion of the container 13) of the container 13. Then, the position (coordinates) where the specific portion is arranged is calculated on the basis of the attitude of the work machine 20 detected by the attitude detector 31. Then, the information of the container 13 is detected on the basis of the position where the specific portion is arranged. In this case, the container detector 33 may be the attitude detector 31.

The work target object detector 34 detects information of the work target object A. The work target object detector 34 detects information of the work target object A in the container 13. The work target object detector 34 may detect a position of the work target object A or may detect a shape of the work target object A. The work target object detector 34 may detect a height (position in the upward/downward direction Z) of the work target object A.

The work target object detector 34 detects three-dimensional information of the work target object A in the container 13. Specifically, the work target object detector 34 may detect information regarding the height (position in the upward/downward direction Z) of the work target object A and information regarding the position of the work target object A in a plane orthogonal to the upward/downward direction Z. The work target object detector 34 may detect the shape of the work target object A. That is, the work target object detector 34 may detect three-dimensional information (three-dimensional coordinates) representing undulations of the surface of the work target object A in the container 13. The work target object detector 34 may detect information of the work target object A arranged at a position different from the inside of the container 13 (for example, information of the work target object A in the distal end attachment 25*c*). The work target object detector 34 may detect the information of the work target object A on the basis of an image of the work target object A. In this case, the work target object detector 34 may be the imaging device 32. The image of the work target object A may include at least one of a two-dimensional image and a distance image.

The loading mass detector 35 detects the mass of the work target object A in the distal end attachment 25*c*, that is, the mass of the work target object A accommodated in the distal end attachment 25*c*. The loading mass detector 35 detects the mass of the work target object A immediately before being loaded into the container 13. For example, the loading mass detector 35 may detect the mass of the work target object A on the basis of the load acting on the distal end attachment 25*c*. In this case, for example, the loading mass detector 35 may be the load detector 37 described later. For example, the loading mass detector 35 may detect a load (loading) acting on the distal end attachment cylinder 26*c* or the like. In this case, the loading mass detector 35 may include a hydraulic sensor that detects a hydraulic pressure (head pressure or rod pressure) of hydraulic oil that operates the distal end attachment cylinder 26*c*. In addition, for example, the loading mass detector 35 may detect a load (loading) acting on the link 25*d* and the like. In this case, the loading mass detector 35 may include, for example, a stress measurement gauge (strain gauge, load cell) or the like. The loading mass detector 35 may calculate the mass of the work target object A on the basis of information of density of the work target object A and an image of the work target object A in the distal end attachment 25*c*. In this case, the loading mass detector 35 may be the imaging device 32. The image of the work target object A may include at least one of a two-dimensional image and a distance image.

The sinking amount detector 36 detects information regarding a decrease amount of a height of the container 13 (in the present embodiment, the cargo bed of the vehicle 10) with respect to the ground (information regarding a sinking amount). A decrease amount (sinking amount) in the height of the container 13 with respect to the wheels of the vehicle 10 correlates with the decrease amount (sinking amount) in the height of the container 13 with respect to the ground. Therefore, the sinking amount detector 36 may detect information regarding the decrease amount (sinking amount) in the height of the container 13 with respect to the wheels of the vehicle 10. The "information regarding the decrease amount (sinking amount)" may be the decrease amount (sinking amount) in the height of the container 13 with respect to the ground or the wheels, or may be an amount (speed of decrease, acceleration of decrease, or the like) regarding a temporal change of the decrease amount (sinking amount). The "information regarding the decrease amount (sinking amount)" may be information regarding an inclination of the container 13 with respect to the horizontal direction, specifically, for example, information indicating how much a certain portion of the container 13 sinks with respect to another portion. The sinking amount detector 36 may include, for example, a sensor provided in a suspension of the vehicle 10. Specifically, for example, the sinking amount detector 36 may include a sensor that detects information (displacement, speed, acceleration, or the like) regarding the amount of stroke of the damper of the suspension of the vehicle 10. The sinking amount detector 36 may include a sensor that detects information regarding a deformation amount (stretching amount, deflection amount, or the like) of the spring of the suspension of the vehicle 10. The information regarding the deformation amount may be the deformation amount, a deformation speed, or a deformation acceleration. The sinking amount detector 36 may detect information regarding the decrease amount (sinking amount) on the basis of the image of the vehicle 10. In this case, the sinking amount detector 36 may be the imaging device 32. The image of the vehicle 10 may include at least one of a two-dimensional image and a distance image.

The load detector 37 detects a value regarding a load (reaction force) received by the distal end attachment 25*c* when the work machine 20 performs a leveling work (leveling operation) to be described later. The value regarding the load detected by the load detector 37 may be a value of the load or a value that can be converted into the load. For example, the load detector 37 may detect a load acting on the attachment 25. Specifically, for example, the load detector 37 may detect a load (for example, stress) acting on at least one of the boom 25*a*, the arm 25*b*, the distal end attachment 25*c*, and the link 25*d*. In this case, the load detector 37 may include a stress measurement gauge (strain gauge). FIG. 1 illustrates the load detector 37 (boom stress measurement gauge 37*a*) provided in the boom 25*a*. In addition, for example, the load detector 37 may detect a load acting on the actuator 26 (cylinder). Specifically, the load detector 37 may detect the hydraulic pressure (head pressure or rod pressure) of the hydraulic oil that operates the hydraulic cylinder. The load detector 37 may detect a load (for example, stress) acting on at least one of a rod and a tube of the cylinder. Note that when the load detector 37 detects a load of at least one of the attachment 25 and the actuator 26, the load detector 37 may also be used as the loading mass detector 35.

The load detector 37 may detect a vehicle body angle of the work machine body 20*a*. When the work machine 20 performs the leveling work (leveling operation), the reaction force received by the distal end attachment 25*c* is transmitted to the work machine body 20*a* via the attachment 25. Then, the work machine body 20*a* may be inclined with respect to the ground. Therefore, the load detector 37 may be a body angle sensor 37*p* that is a sensor that detects an angle (vehicle body angle) of the work machine body 20*a*. The value regarding the load detected by the load detector 37 may be the angle of the work machine body 20*a*. For example, the load detector 37 may detect an angle (inclination or pitch angle) in the upward/downward direction Z of the work machine body 20*a* with respect to the horizontal direction. The load detector 37 may detect a pitch angle of the upper slewing body 23 or may detect a pitch angle of the lower travelling body 21. The load detector 37 may detect an angle (inclination or pitch angle) in the upward/downward direction Z of the upper slewing body 23 with respect to the lower travelling body 21.

The operation unit 41 (see FIG. 3) is used by a worker to input information. The operation unit 41 illustrated in FIG. 3 gives an instruction to the controller 50 on the basis of an operation by the worker. In a case where the operation unit 41 is provided in the work machine 20, the operation unit 41 may be, for example, a display, an operation lever, or the like provided in the cab 23*a*. The operation unit 41 may be a tablet, a smartphone, or a personal computer. The operation unit 41 may be provided in the server. The operation performed by the operation unit 41 may be, for example, an operation for instructing a work mode to be described later, or an operation for setting various setting values (adjustment value, threshold, or the like).

The controller 50 is a computer that inputs and outputs signals, performs arithmetic (processing), stores information, and the like. For example, the function of the controller 50 is implemented by causing an arithmetic unit to execute a program stored in a storage unit of the controller 50. For example, the controller 50 receives a detection result from the detection unit 30. For example, the controller 50 performs control to cause the work machine 20 to automatically operate. That is, the controller 50 is an automatic operation controller. For example, the controller 50 outputs a command for operating the work machine 20. The controller 50 includes a detection result acquisition unit 50*a*, a loading mass integration unit 51, a work plan setting unit 53, a work mode setting unit 55, a leveling operation end determination unit 56, an actual speed acquisition unit 57, and an automatic operation control unit 59.

The detection result acquisition unit 50*a* acquires a detection result of the detection unit 30. For example, the detection result acquisition unit 50*a* may acquire a detection result of the state of the work target object A in the container 13, and specifically, for example, may acquire a detection result of the work target object detector 34. The detection result acquisition unit 50*a* may acquire a detection result of the state of the container 13, and specifically, for example, may acquire a detection result of at least one of the container detector 33 and the sinking amount detector 36. The detection result acquisition unit 50*a* may acquire a detection result of the state of the work machine 20, and specifically, for example, may acquire a detection result of at least one of the attitude detector 31 and the load detector 37. The detection result acquisition unit 50*a* may acquire a detection result of the imaging device 32 or may acquire a detection result of the loading mass detector 35.

The loading mass integration unit 51 calculates an integrated value of the mass of the work target object A loaded into the container 13 illustrated in FIG. 1. The loading mass integration unit 51 calculates an integrated value from the start of the loading work to be described later (a state where the container 13 has no or approximately no work target object A) to the present. The loading mass integration unit 51 integrates the mass of the work target object A detected by the loading mass detector 35 at the time of loading the work target object A from the distal end attachment 25*c* to the container 13 every time.

The work plan setting unit 53 sets a work plan of the work machine 20. The work plan is information regarding a work target of the work machine 20. The work plan may include information of a target range in which the distal end attachment 25*c* performs work. The information of the target range may include, for example, information of a target capturing range C to be described later illustrated in FIG. 2. The work plan may include information of a target path of a specific portion of the attachment 25. The specific portion may be, for example, the arm distal end portion 25*bt* or the distal end attachment distal end portion 25*ct*. The target path of the specific portion may be, for example, the target path P of the leveling work illustrated in FIG. 5.

The work plan may include information of the slewing angle of the upper slewing body 23. The work plan may include information of a radius from a slewing center of the upper slewing body 23 with respect to the lower travelling body 21 to the specific portion (information in the machine forward/rearward direction X). The work plan may include information of the height (position in the upward/downward direction Z) of the specific portion. The information of the height of the specific portion may include, for example, information of the height from the lower portion of the upper slewing body 23 to the specific portion. At least a part of the work plan may be set by the work plan setting unit 53 on the basis of teaching, or may be set by the work plan setting unit 53 on the basis of a method other than teaching (for example, numerical value input by an operator).

The work mode setting unit 55 sets a work mode. The work mode is a type of operation of work performed by the work machine 20. The work mode setting unit 55 selects and sets one work mode from a plurality of work modes. The work mode setting unit 55 changes the work mode. The work mode can be variously set. The work mode includes a leveling work mode. The work mode may include a mode of work different from the leveling work. Specifically, for example, the work mode may include a loading work mode to be described later, and may include a work mode for stirring or moving the work target object A within a certain range, and the like.

The leveling operation end determination unit 56 determines whether or not a leveling operation end condition (see FIG. 7) is satisfied. The leveling operation end determination unit 56 determines whether or not to end (stop) the leveling operation during the leveling operation to be described later. Details of this determination will be described later.

The actual speed acquisition unit 57 acquires a value regarding the actual speed of the attachment 25. The "value regarding the actual speed of the attachment 25" may be a value of the actual speed of the attachment 25 or may be a value that can be converted into the actual speed of the attachment 25. The "actual speed of the attachment 25" may be, for example, the actual speed of the distal end attachment 25*c*. Hereinafter, the value regarding the actual speed of the attachment 25 is also simply referred to as "actual speed of the attachment 25". The actual speed acquisition unit 57 may acquire the actual speed of the attachment 25 from the detection result of the attitude detector 31. Specifically, for example, the actual speed acquisition unit 57 may acquire an angular speed of the attachment 25 (for example, an angular speed of the boom 25*a* with respect to the upper slewing body 23). In this case, the actual speed acquisition unit 57 may calculate the angular speed from the angle or the angular acceleration of the attachment 25 (the calculation is included in the acquisition). The actual speed acquisition unit 57 may acquire the actual speed of the attachment 25 on the basis of information of a change in inclination of the attachment 25 with respect to the horizontal direction (for example, inclination of the boom 25*a*). The actual speed acquisition unit 57 may acquire the actual speed of the attachment 25 on the basis of information of the stroke speed of the actuator 26 (cylinder). The actual speed acquisition unit 57 may acquire the actual speed of the attachment 25 on the basis of the information of the change in the image detected by the attitude detector 31 (the image captured by the imaging device 32). In this case, for example, the actual speed acquisition unit 57 may calculate the actual speed of the attachment 25 on the basis of a difference (change) of the image using the image for each control cycle.

The automatic operation control unit 59 controls automatic operation of the work machine 20 so that the work machine 20 operates according to the work plan. The automatic operation control unit 59 illustrated in FIG. 3 calculates a command (operation amount) to be output to the drive control unit 27 so that the work machine 20 operates (performs automatic operation) according to the work plan, and outputs the command to the drive control unit 27. The automatic operation control unit 59 may control the operation of the work machine 20 on the basis of a detection value of the attitude detector 31.

(Operation)

The work system 1 is configured to operate as follows. An outline of the operation of the work system 1 is as follows. The controller 50 (specifically, the automatic operation control unit 59) causes the work machine 20 to perform a leveling work by automatic operation. The leveling work is a work including a plurality of leveling operations. Specifically, the work plan setting unit 53 sets a work plan for the leveling work. The work mode setting unit 55 sets (selects) a mode of the leveling work. The automatic operation control unit 59 operates the work machine 20 according to the work plan corresponding to the mode (leveling work mode) set by the work mode setting unit 55. As a result, the work machine 20 performs the leveling work by automatic operation according to the work plan. Similarly to the leveling work, the controller 50 may cause the work machine 20 to perform the loading work by automatic operation.

(Arrangement of Work Machine 20 with Respect to Container 13)

The work machine 20 illustrated in FIG. 1 may be arranged at various relative positions with respect to the container 13. For example, the work machine 20 may be arranged so as to face the container 13 in the container forward/rearward direction V. In the example illustrated in FIG. 1, the work machine 20 is arranged in the container rearward direction V2 with respect to the container 13. For example, as illustrated in FIG. 2, the work machine 20 may be arranged so as to face the container 13 in the container width direction W. In the example illustrated in FIG. 2, the work machine 20 is arranged in the container leftward direction W1 with respect to the container 13. The work machine 20 may be arranged in the container rightward direction W2 with respect to the container 13. Hereinafter, the controller 50 and components (for example, the automatic operation control unit 59 and the like) of the controller 50 will be described with reference to FIG. 3, and steps S10 to S20 illustrated in FIG. 4 will be described with reference to FIG. 4.

(Loading Work)

Figure 4:
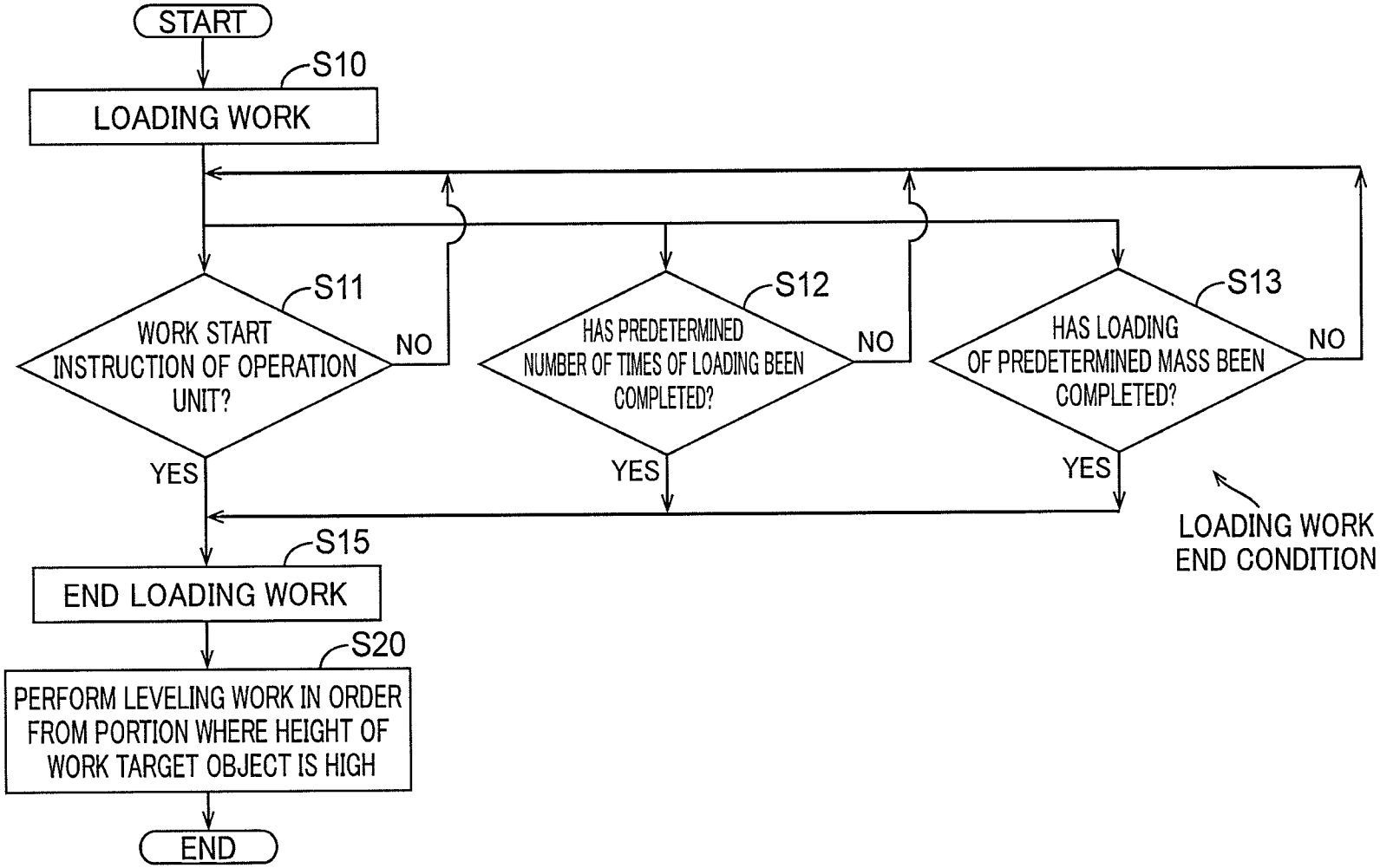
FIG. 4 is a flowchart illustrating processing by a controller of the work system according to the first embodiment.

The controller 50 may cause the work machine 20 illustrated in FIG. 2 to perform the loading work by automatic operation (step S10 in FIG. 4). The loading work is a work of loading the work target object A into the container 13 by the distal end attachment 25*c*. A specific example of the loading work is as follows. The loading work includes a plurality of work phases (work contents). For example, the plurality of work phases includes a capturing phase, a lifting slewing phase, a release phase, and a return slewing phase. The capturing phase is a phase in which the distal end attachment 25*c* captures the work target object A in the target capturing range C (for example, excavates earth and sand). For example, the target capturing range C may be set at a place where the work target object A is collected (for example, a soil sand pile, a soil pit, and the like), or may be set on the ground as an excavation object. The lifting slewing phase is a phase in which the distal end attachment 25*c* moves from the target capturing range C toward a position immediately above the container 13 in a state where the distal end attachment 25*c* captures the work target object A. In the lifting slewing phase, the distal end attachment 25*c* moves in the machine slewing direction Sw and the upward/downward direction Z (mainly the upward direction Z1). The release phase is a phase in which the distal end attachment 25*c* releases (for example, discharges) the work target object A immediately above the container 13 (loading position E). The return slewing phase is a phase in which the distal end attachment 25*c* moves from the position immediately above the container 13 toward the target capturing range C. In the return slewing phase, the distal end attachment 25*c* moves in the machine slewing direction Sw and the upward/downward direction Z (mainly the downward direction Z2). In the loading work, a series of work phases including the capturing phase, the lifting slewing phase, the release phase, and the return slewing phase is repeatedly performed.

(Loading Work End Condition)

In the controller 50 (specifically, the work mode setting unit 55), a loading work end condition is set in advance (before the determination of the end of the loading work is performed). The loading work end condition is a condition for ending the loading work on the work machine 20. The loading work end condition is also a condition (leveling work start condition) for causing the work machine 20 to start the leveling work. The loading work end condition can be set variously. The loading work end condition may include only one condition, or may include a plurality of conditions as illustrated in FIG. 4. When the loading work end condition includes a plurality of conditions, the controller 50 may end the loading work when at least one of the plurality of conditions included in the loading work end condition is satisfied, or may end the loading work when two or more (for example, all) of the plurality of conditions included in the loading work end condition are satisfied. A specific example of the loading work end condition is as follows.

(Operation of Operation Unit 41 or the Like)

The loading work end condition may include that a command to end the loading work is output. The loading work end condition may include that a command to start the leveling work is output. The loading work end condition may include that a command to change the work mode from the loading work mode to the leveling work mode is output. For example, the loading work end condition may include that the above command is output from the operation unit 41 (see FIG. 3) (step S11 in FIG. 4). Note that the loading work end condition may include that a command to end the loading work (a command not depending on an operation by the worker) is output from an element other than the operation unit 41.

(Number of Times of Loading Work or the Like)

The loading work end condition may include that the number of times of loading from the distal end attachment 25*c* to the container 13 illustrated in FIG. 2 (the number of times of performing the series of phases) has reached a predetermined number of times (number threshold) (step S12 in FIG. 4). [Example 1A] The number threshold may be set by manual operation of the worker (for example, input of information to the operation unit 41 by the worker). [Example 1Aa] For example, a value of the number of times that is the number threshold may be set by the operation unit 41. [Example 1Ab] For example, information for setting the number threshold may be set by the operation unit 41, and the controller 50 may calculate the number threshold on the basis of the information set by the operation unit 41. Specifically, for example, the controller 50 may calculate the number threshold on the basis of manually set information (dimensions and the like) of the container 13. [Example 1B] The number threshold may be automatically set by the controller 50. For example, the controller 50 may calculate the number threshold on the basis of the information of the container 13 detected by the container detector 33. [Example 1C] The number threshold may be an initial value, a fixed value, or the like preset in the controller 50.

Various setting values (such as thresholds) other than the number threshold may be manually set by the worker, may be automatically calculated by the controller 50, or may be values preset in the controller 50.

(Integrated Loading Mass)

The loading work end condition may include that the mass of the work target object A loaded into the container 13 in the loading work has reached a target value (integrated loading mass threshold) (step S13 in FIG. 4). More specifically, the loading work end condition may include that the value calculated by the loading mass integration unit 51 (see FIG. 3) has reached the integrated loading mass threshold (has become equal to or more than the integrated loading mass threshold).

(End of Loading Work)

When the loading work end condition is satisfied, the controller 50 causes the work machine 20 to end the loading work (step S15 in FIG. 4). Specifically, for example, when ending the loading work, the automatic operation control unit 59 outputs a command to end the loading work to the drive control unit 27. As a result, the work machine 20 ends the loading work.

(State of Work Target Object A at End of Loading Work)

As illustrated in FIG. 1, when the loading work is finished (at the time when the loading work is finished), the work target object A in the container 13 includes a plurality of mountain-shaped portions. A portion that is a top of each mountain-shaped portion in the work target object A is referred to as a top portion. In the specific example illustrated in FIG. 1, the work target object A includes three mountain-shaped portions, and top portions of the three mountain-shaped portions are referred to as a first top portion A1, a second top portion A2, and a third top portion A3.

Note that the number and positions of the top portions of the work target object A can vary depending on, for example, the number of times of series of phases in the loading work and relative positions of the work machine 20 and the container 13. For example, in the example illustrated in FIG. 2, the plurality of top portions (the first top portion A1, the second top portion A2, and the third top portion A3) is formed at positions shifted from each other in the container forward/rearward direction V and are not shifted from each other in the container width direction W, but the present invention is not limited to such an arrangement. For example, the plurality of top portions may not be shifted from each other in the container forward/rearward direction V, and may be formed so as to be aligned in the container width direction W, and may be shifted from each other in the container width direction W.

(Leveling Work)

The controller 50 (specifically, the automatic operation control unit 59) causes the work machine 20 illustrated in FIG. 1 to start the leveling work, for example, after completion of the loading work. The leveling work is a work of leveling the work target object A loaded into the container 13 by using the distal end attachment 25*c*.

(Leveling Operation)

In the leveling work, the controller 50 (specifically, the automatic operation control unit 59) causes the work machine 20 to perform the leveling operation of leveling the work target object A in the container 13 with the distal end attachment 25*c* by automatic operation. The controller 50 may cause, in the leveling work, the distal end attachment 25*c* of the work machine 20 to perform the leveling operation only once, or may cause the distal end attachment 25*c* to perform a plurality of leveling operations. In the present embodiment, the leveling work includes a plurality of leveling operations. The leveling operation by the distal end attachment 25*c* includes a press-leveling operation which is an operation of pressing and leveling the work target object A. In the leveling operation, a part (specifically, for example, the leveling surface 25*c*2) of the distal end attachment 25*c* presses and levels the work target object A in the container 13.

The direction (pressing direction) in which the distal end attachment 25*c* presses the work target object A in the leveling operation may be the downward direction Z2. That is, the plurality of leveling operations may include a press-leveling operation in the downward direction Z2. In this case, the pressing direction may be a direction directly below the distal end attachment 25*c* (a direction coinciding with a vertically downward direction), or may be a direction inclined with respect to the direction directly below (obliquely downward direction). In addition, the pressing direction may be a horizontal direction (a direction orthogonal to the upward/downward direction Z). That is, the plurality of leveling operations may include a press-leveling operation in a horizontal direction (horizontal leveling operation). In this case, the direction of movement of the distal end attachment 25*c* may be the machine forward direction X1, the machine rearward direction X2, or the machine slewing direction Sw. Hereinafter, the leveling operation when the direction of movement of the distal end attachment 25*c* is the machine rearward direction X2 may be referred to as a horizontal pull-leveling operation.

Figure 5:
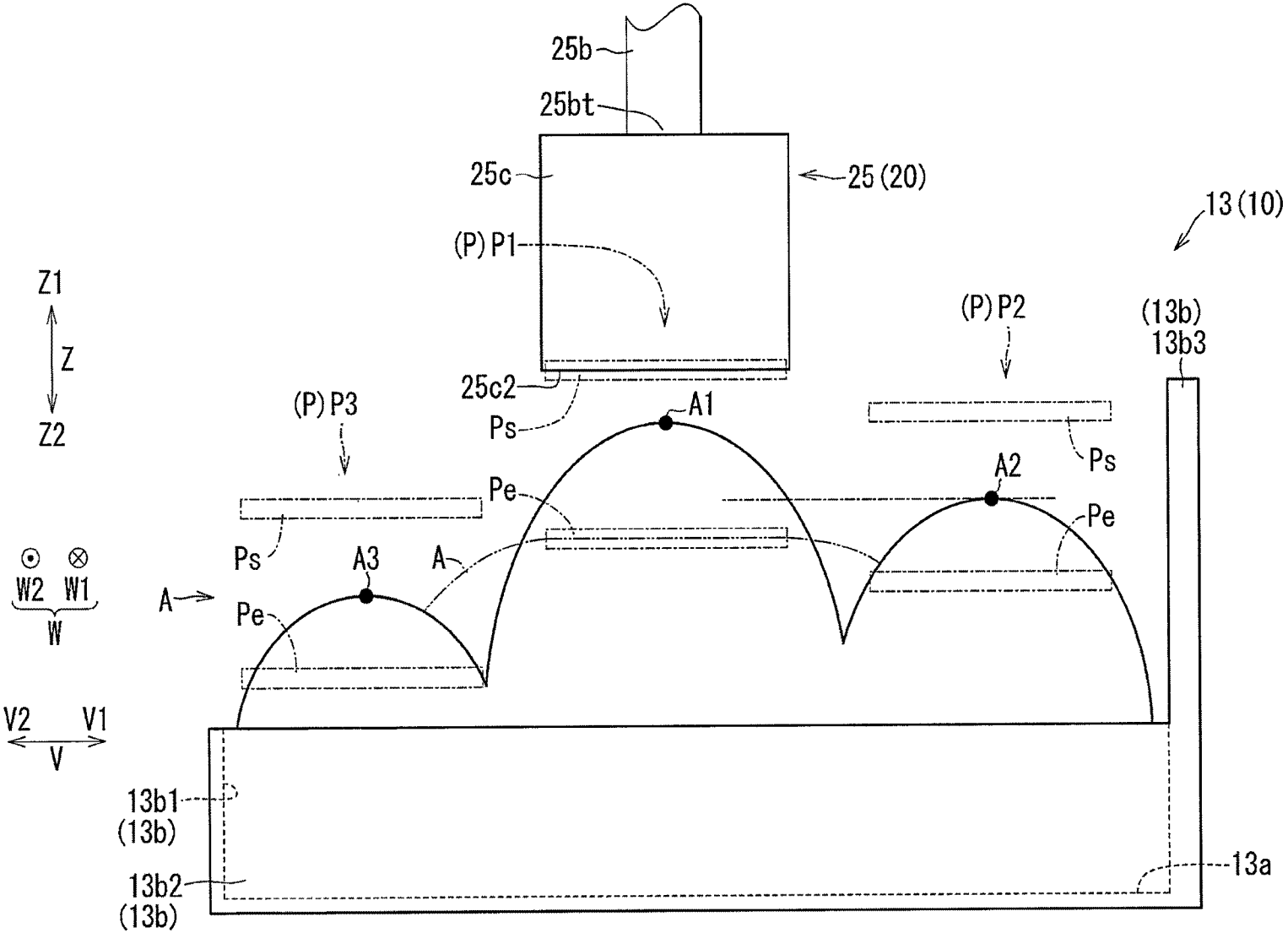
FIG. 5 is a view of a cargo bed (container) of the vehicle, a work target object, and a bucket as viewed from a side.

As illustrated in FIG. 5, when a mountain-shaped high portion (for example, the first top portion A1 and its peripheral portion) of the work target object A is pressed and leveled by the distal end attachment 25*c*, the mountain-shaped high portion of the work target object A is crushed. Then, the mountain-shaped high portion of the work target object A flows to a low portion of the work target object A, for example, a portion outside the peripheral portion of the first top portion A1, and the high portion collapses. As a result, the high portion of the work target object A becomes lower, and the low portion of the work target object A becomes higher. At this time, as indicated by a two-dot chain line in FIG. 5, the work target object A is leveled in a range wider than the leveling surface 25*c*2, and the wider range becomes flat or approximately flat.

When the leveling operation is performed, as illustrated in FIG. 1, the distal end attachment 25*c* is set to an attitude (angle) suitable for pressing and leveling the work target object A. Specifically, for example, the controller 50 sets the attitude of the distal end attachment 25*c* so that the leveling surface 25*c*2 is parallel or approximately parallel to the horizontal direction as indicated by a two-dot chain line in FIG. 1.

(Determination of Leveling Operation)

As illustrated in FIG. 5, the controller 50 (specifically, the automatic operation control unit 59) causes the work machine 20 to perform a leveling operation on the basis of the detection result acquired by the detection result acquisition unit 50*a*. Specifically, the controller 50 determines at least one of a leveling operation start position Ps and a leveling operation end position Pe on the basis of the detection result acquired by the detection result acquisition unit 50*a*. Then, the controller 50 causes the work machine 20 to perform the leveling operation on the basis of the determined position. In the present embodiment, the controller 50 determines both the leveling operation start position Ps and the leveling operation end position Pe.

The leveling operation start position Ps is a start position of the leveling operation (one leveling operation). Specifically, in the leveling operation (one leveling operation) performed at a place corresponding to a certain position P1, the leveling operation start position Ps is the position of the distal end attachment 25*c* when the distal end attachment 25*c* starts the leveling operation. In the example illustrated in FIG. 5, the leveling operation start position Ps is the position of the leveling surface 25*c*2 at the start of the leveling operation.

The leveling operation end position Pe is an end position of the leveling operation (one leveling operation). For example, when the distal end attachment 25*c* performs the press-leveling operation of pressing the work target object A in the downward direction Z2, the leveling operation end position Pe is the position of the distal end attachment 25*c* when the distal end attachment 25*c* is arranged lowermost in the downward direction Z2 in the leveling operation (one leveling operation) performed immediately below the certain position P1. In the example illustrated in FIG. 5, the leveling operation end position Pe is the position of the leveling surface 25*c*2 at the end of the leveling operation.

(Position and Order of Leveling Operation)

Hereinafter, a case where the controller 50 causes the work machine 20 to perform a plurality of leveling operations in the leveling work will be mainly described. In this case, the leveling work includes a plurality of leveling operations. The controller 50 causes the distal end attachment 25*c* to perform a plurality of leveling operations while changing the position of the distal end attachment 25*c*. In the example illustrated in FIG. 5, the controller 50 causes the distal end attachment 25*c* to perform the leveling operation at a location corresponding to each of the position P1, a position P2, and a position P3. On the basis of the detection result acquired by the detection result acquisition unit 50*a* (specifically, the detection result of the work target object detector 34), the controller 50 causes the work machine 20 to perform a leveling operation (leveling work) so as to level the work target object A in the container 13 in order from a high portion. More specifically, on the basis of the detection result of the work target object detector 34, the controller 50 determines the leveling operation start position Ps of each time so as to level the work target object A in the container 13 in order from the high portion. Then, the controller 50 causes the work machine 20 to perform the leveling operation of each time so as to start the leveling operation from the determined leveling operation start position Ps. The height of the high portion of the work target object A may be the height of the work target object A before the leveling work is performed, or may be the height of the work target object A immediately before the leveling operation of each time after the height has changed in the leveling work. Specifically, for example, the leveling work may be performed in the order described in [Example 2A] below, or may be performed in the order described in [Example 2B] below.

[Example 2A] The controller 50 may cause the work machine 20 to perform the leveling work in descending order of heights of a plurality of vertex portions (the first top portion A1, the second top portion A2, and the third top portion A3) at a time point before the leveling work is performed (at the start of the leveling work). Specifically, for example, the controller 50 stores the positions of the plurality of vertex portions (the first top portion A1, the second top portion A2, and the third top portion A3) detected by the work target object detector 34 at the start of the leveling work. The controller 50 specifies the order (in the specific example illustrated in FIG. 5, the order of the first top portion A1, the second top portion A2, and the third top portion A3) of the heights of the plurality of vertex portions.

Next, the controller 50 causes the distal end attachment 25*c* to perform the leveling operation at the position P1 corresponding to the highest first top portion A1 of the work target object A in the container 13 and in the vicinity thereof. Next, the controller 50 causes the distal end attachment 25*c* to perform the leveling operation at and near the position P2 corresponding to the second highest vertex portion (second top portion A2) at the start of the leveling work. At this time, even if a portion higher than the second top portion A2 exists in the work target object A in the container 13, the controller 50 may cause the distal end attachment 25*c* to perform the leveling operation at the position P2 corresponding to the second top portion A2 and in the vicinity thereof. Next, the controller 50 causes the distal end attachment 25*c* to perform the leveling operation at and near the position P3 corresponding to the third highest vertex portion (third top portion A3) at the start of the leveling work. At this time, even if a portion higher than the third top portion A3 exists in the work target object A in the container 13, the controller 50 may cause the distal end attachment 25*c* to perform the leveling operation at the position P3 corresponding to the third top portion A3 and in the vicinity thereof.

[Example 2B] The controller 50 may cause the work machine 20 to perform the leveling work so as to level the highest portion of the work target object A in the container 13 at a time point before each leveling operation (at the start of each leveling operation). Specifically, for example, similarly to the above Example 2A, the controller 50 causes the distal end attachment 25*c* to perform the leveling operation (first leveling operation) at and near the position P1 corresponding to the highest first top portion A1 of the work target object A in the container 13. Then, the shape of the work target object A in the container 13 changes. At this time, the work target object detector 34 detects the shape of the work target object A after the first leveling operation. Then, the controller 50 causes the distal end attachment 25*c* to perform the leveling operation (second leveling operation) in the highest portion of the work target object A after the first leveling operation. At this time, the highest portion of the work target object A after the first leveling operation is not limited to the second top portion A2. Similarly, the work target object detector 34 detects the shape of the work target object A after the second leveling operation. Then, the controller 50 causes the distal end attachment 25*c* to perform the leveling operation in the highest portion of the work target object A after the second leveling operation. At this time, the highest portion of the work target object A after the second leveling operation is not limited to the second top portion A2 and is not limited to the third top portion A3.

(Position of Distal End Attachment 25*c* with Respect to Top Portion)

Next, a case where the distal end attachment 25*c* performs a leveling operation of pressing and leveling the work target object A directly below or approximately directly below the distal end attachment will be described. The controller 50 disposes the distal end attachment 25*c* as follows when causing the distal end attachment 25*c* to perform the press-leveling operation immediately below a position corresponding to a certain top portion. For example, when the leveling operation is performed immediately below the position P1 corresponding to the first top portion A1, the distal end attachment 25*c* is arranged so that the leveling surface 25*c*2 and the first top portion A1 face each other in the upward/downward direction Z. That is, as illustrated in FIG. 2, when the work target object A is viewed from above, the distal end attachment 25*c* is arranged so that the first top portion A1 is included within the range of the position (position P1) of the leveling surface 25*c*2. For example, when the work target object A is viewed from above, the distal end attachment 25*c* may be arranged so that a central portion (central portion of the position P1) of the leveling surface 25*c*2 and the first top portion A1 coincide or approximately coincide with each other. In this press-leveling operation, as illustrated in FIG. 1, the distal end attachment 25*c* moves in the downward direction Z2 in a state where the leveling surface 25*c*2 and the first top portion A1 face each other in the upward/downward direction Z. As a result, the distal end attachment 25*c* levels the first top portion A1 and the work target object A therearound.

(Horizontal Leveling)

Next, a case where the distal end attachment 25*c* performs a leveling operation (horizontal leveling operation) of pressing and leveling the work target object A in a horizontal direction or an approximately horizontal direction will be described. In this case, the controller 50 causes the distal end attachment 25*c* to perform the horizontal leveling operation so as to level the work target object A in the container 13 in order from a high portion. Specifically, for example, the controller 50 may cause the distal end attachment 25*c* to perform horizontal leveling at the first top portion A1 and the peripheral portion of the first top portion A1. The peripheral portion of the first top portion A1 may be, for example, a position that does not reach the second top portion A2 and the third top portion A3. In addition, the controller 50 may cause the distal end attachment 25*c* to perform the horizontal leveling operation in the region from the first top portion A1 to the second top portion A2. On the other hand, a case where the distal end attachment 25*c* performs the horizontal pull-leveling operation in the region from the first top portion A1 to the third top portion A3 does not correspond to leveling the work target object A in the container 13 in order from a high portion.

(Distance from End of Container 13 to Distal End Attachment 25*c*)

As illustrated in FIG. 2, the controller 50 preferably controls the position of the distal end attachment 25*c* so that the contact between the container 13 (for example, the container wall surface 13*b*) and the distal end attachment 25*c* can be suppressed when the leveling work is performed, that is, when the leveling operation of each time is performed. For example, the controller 50 may control the position of the distal end attachment 25*c* so that a distance (horizontal distance) in the horizontal direction between the distal end attachment 25*c* and the container wall surface 13*b* when the leveling work is performed is equal to or more than a predetermined threshold (distance threshold). The distance threshold can be set in various ways. The distance threshold may be manually set by the worker, or may be automatically set by the controller 50 (specifically, the work plan setting unit 53). For example, the distance threshold may be automatically set by the controller 50 on the basis of the information of the container 13 detected by the container detector 33 and information of dimensions of the distal end attachment 25*c*. The distance threshold may be an initial value, a fixed value, or the like preset in the controller 50.

(Pushing Out of Work Target Object A)

Figure 6:
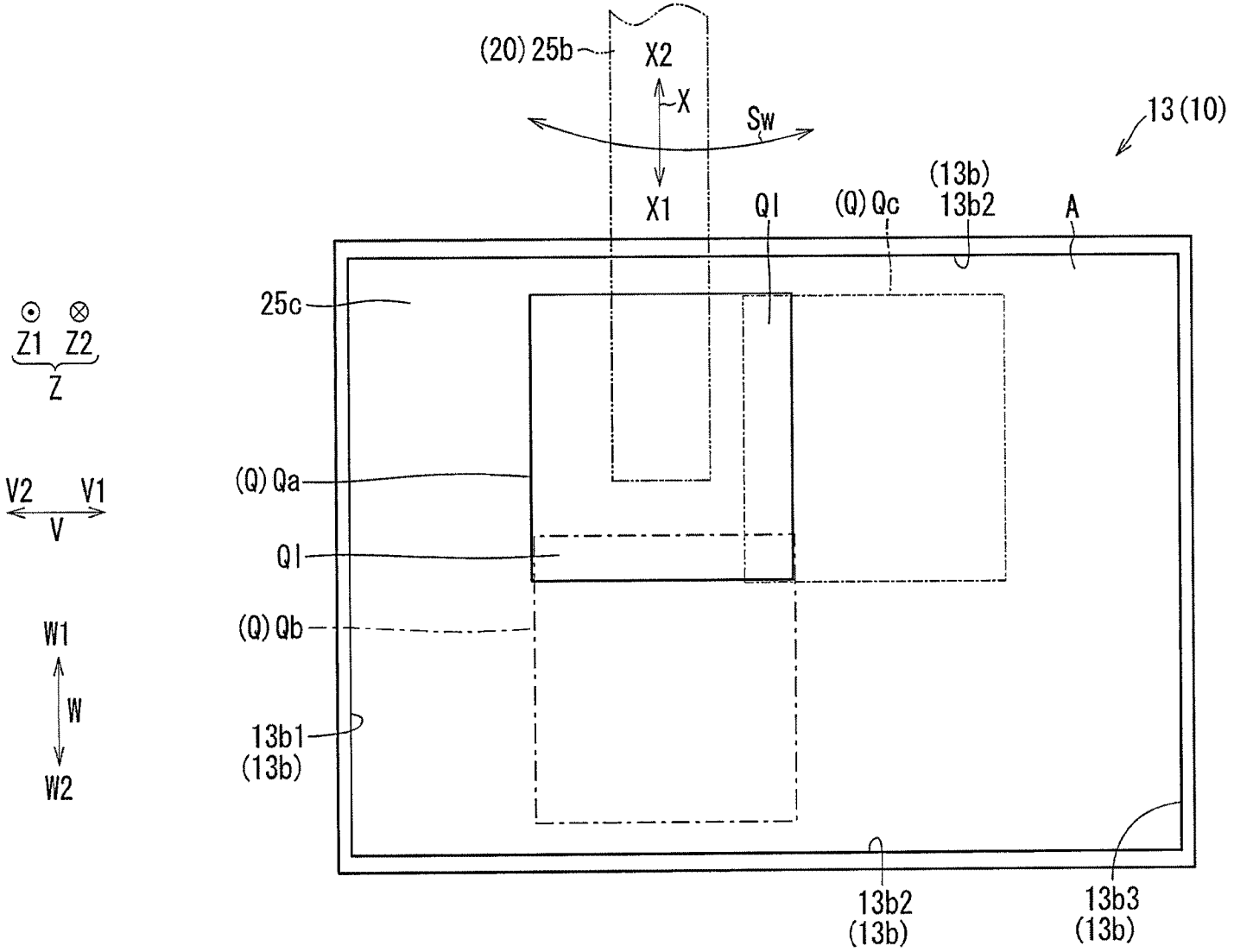
FIG. 6 is a view of the cargo bed (container) of the vehicle, the work target object, and the bucket as viewed from above.

As illustrated in FIG. 6, when the container 13 is viewed from above, a range in which the distal end attachment 25*c* levels the work target object A in one leveling operation at a place corresponding to a certain position (for example, a place corresponding to the position P1 illustrated in FIG. 2) is referred to as a leveling operation range Q. The leveling operation range Q in a case where the distal end attachment 25*c* performs the press-leveling operation immediately below (or approximately immediately below) the distal end attachment 25*c* is a region immediately below (or approximately immediately below) the distal end attachment 25*c* (specifically, the leveling surface 25*c*2). That is, the leveling operation range Q is a range of the work target object A that is lower in the downward direction Z2 than the distal end attachment 25*c* that performs the leveling operation and faces the distal end attachment 25*c* in the upward/downward direction Z. In this case, when the container 13 is viewed from above, the size of the leveling operation range Q is the same as or approximately the same as the size of the distal end attachment 25*c*. The leveling operation range Q in a case where the distal end attachment 25*c* performs the press-leveling in the horizontal direction may be a range of the work target object A in which the distal end attachment 25*c* and the work target object A are predicted to come into contact in the leveling operation, and may be a range when the range is viewed from above. In this case, when viewed from above, the size of the leveling operation range Q may be wider than the size of the distal end attachment 25*c* (not illustrated). Note that when the press-leveling operation is performed, the leveling operation range Q can also be referred to as a range of the leveling surface 25*c*2 when the leveling surface 25*c*2 arranged at the target position such as the position P1 illustrated in FIG. 2 when leveling the work target object A is viewed from above.

When the distal end attachment 25*c* performs the leveling operation of leveling the work target object A, a part of the work target object A is pushed out to the periphery of the leveling operation range Q and protrudes from the range. Further, an upper surface of the work target object A around the leveling operation range Q may become higher than an upper surface of the work target object A in the leveling operation range Q. In this case, the leveling operation is preferably performed so as to level the work target object A pushed out around the leveling operation range Q.

Specifically, for example, as described above, the controller 50 causes the work machine 20 to perform the leveling operation while sequentially updating the leveling operation range Q to various positions in the container 13 so as to level the work target object A in the container 13 in order from a high portion. At this time, the controller 50 preferably changes the leveling operation range Q so that parts of the adjacent leveling operation ranges Q overlap each other. Thus, a lap portion Q1 in which parts of the adjacent leveling operation ranges Q overlap each other is formed. The controller 50 preferably sets the target path P of the leveling work so that the lap portion Q1 is provided. The target path P includes a plurality of target positions, and the plurality of target positions include, for example, the target position P1, the target position P2, and the target position P3 illustrated in FIGS. 2 and 5. The controller 50 controls the operation of the work machine 20 so that the specific portion (for example, the arm distal end portion 25*bt*) of the attachment 25 sequentially moves through the plurality of target positions included in the target path P, and controls the operation of the work machine 20 so that the distal end attachment 25*c* performs the leveling operation at the place corresponding to each of the plurality of target positions. Note that the leveling operation start position Ps to be described later may be set at the same position as each target position, or may be set immediately below each target position.

The direction in which the two adjacent leveling operation ranges Q are arranged may be the container forward/rearward direction V, the container width direction W, the machine slewing direction Sw, or the machine forward/rearward direction X. In the example illustrated in FIG. 6, the direction in which the two adjacent leveling operation ranges Q are arranged is the container forward/rearward direction V or the container width direction W. More specifically, in the specific example of FIG. 6, a leveling operation range Qa and a leveling operation range Qb located adjacent to the leveling operation range Qa are arranged in the container width direction W, and an end portion of the leveling operation range Qa and an end portion of the leveling operation range Qb overlap each other. Further, the leveling operation range Qa and a leveling operation range Qc located adjacent to the leveling operation range Qa are arranged in the container forward/rearward direction V, and an end portion of the leveling operation range Qa and an end portion of the leveling operation range Qc overlap each other.

The width of the lap portion Q1 (the amount of overlap) may be set by manual operation of the worker (for example, input of information to the operation unit 41 by the worker), or may be automatically set by the controller 50 (the work plan setting unit 53). For example, the width of the lap portion Q1 may be set on the basis of the shape of the work target object A around the leveling operation range Q detected by the work target object detector 34, that is, the shape of the work target object A pushed out around the leveling operation range Q.

(Height of Leveling Operation Start Position Ps)

For example, the controller 50 may set a height (position in upward/downward direction Z) of the leveling operation start position Ps in the leveling operation (one leveling operation) in a place corresponding to the certain position P1 illustrated in FIG. 5 as follows.

[Example 3A] The leveling operation start position Ps may be set higher in the upward direction Z1 than the work target object A immediately below the position P1. In this case, the leveling operation start position Ps may be calculated on the basis of the height of the work target object A detected by the work target object detector 34. Specifically, for example, the leveling operation start position Ps may be set to a position corresponding to the position P1 and a height obtained by adding a preset value (a value equal to or more than zero) to the height of the top portion of the work target object A immediately below the position P1.

[Example 3B] When the leveling operation end position Pe is determined even if the leveling operation is not performed as described later, the leveling operation start position Ps may be set on the basis of the leveling operation end position Pe. For example, the leveling operation start position Ps may be a position in the upward direction Z1 from the leveling operation end position Pe by a predetermined value. The predetermined value may be set by manual operation of the worker (for example, input to the operation unit 41 by the worker), or may be automatically set by the controller 50.

(Leveling Operation End Position Pe)

The controller 50 may set the leveling operation end position Pe in the leveling operation (one leveling operation) at the certain position P1 as follows, for example. The leveling operation end position Pe may be determined while the leveling operation is being performed at the place corresponding to the position P1 ([Example 4] below). The leveling operation end position Pe may be a position determined without performing the leveling operation ([Example 5] below). Hereinafter, each step (S21 to S51) illustrated in FIG. 7 will be described with reference to FIG. 7.

[Example 4] The leveling operation end position Pe may be determined while the leveling operation is being performed at the place corresponding to the position P1 (after step S21). In this case, the leveling operation end determination unit 56 determines whether or not a leveling operation end condition (see steps S31, S41 to S44) is satisfied. The leveling operation end condition is a condition that the controller 50 (specifically, the automatic operation control unit 59) causes the distal end attachment 25*c* to end (stop) the leveling operation. The leveling operation end condition is set in the controller 50 in advance (before the leveling operation). The controller 50 may set the position of the distal end attachment 25*c* when the leveling operation end condition is satisfied as the leveling operation end position Pe. Then, after finishing the current leveling operation (after step S51), the controller 50 causes the distal end attachment 25*c* to perform the next leveling operation.

Figure 7:
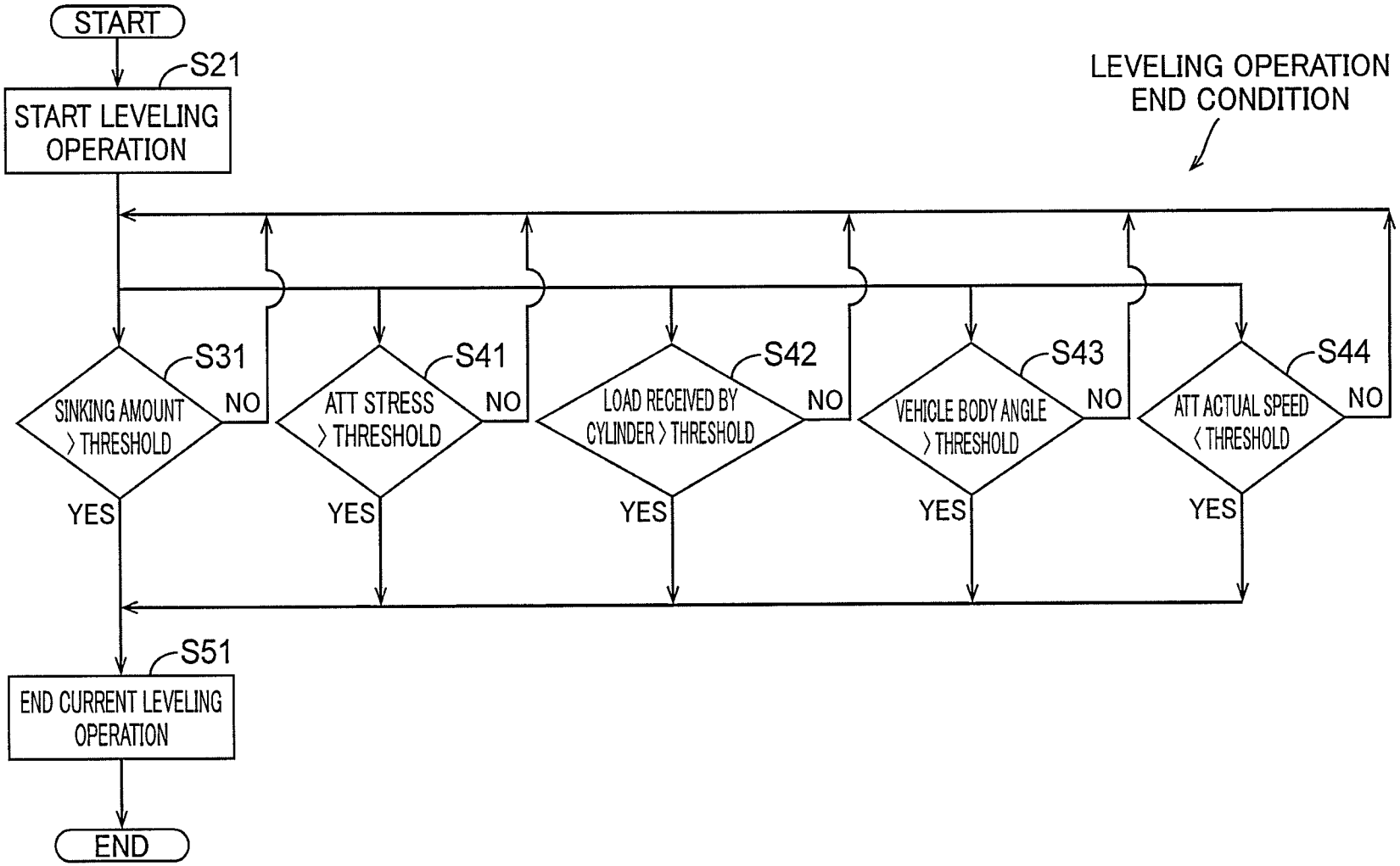
FIG. 7 is a flowchart illustrating processing by a leveling operation end determination unit of the controller.

The leveling operation end condition may include only one condition, or may include a plurality of conditions as illustrated in FIG. 7. When the leveling operation end condition includes a plurality of conditions, the leveling operation end determination unit 56 may determine that the leveling operation end condition is satisfied when at least one of the plurality of conditions is satisfied (see steps S31, S41 to S44). In addition, the leveling operation end determination unit 56 may determine that the leveling operation end condition is satisfied when two or more or all of the plurality of conditions are satisfied.

The leveling operation end condition may include a condition regarding the container 13 (cargo bed of the vehicle 10) as described in [Example 4A] below, or may include a condition regarding the work machine 20 as described in [Example 4B] below.

[Example 4A] The leveling operation end condition may include a condition regarding the sinking amount of the cargo bed of the vehicle 10 as the container 13. Specifically, the leveling operation end condition may include that a value regarding the sinking amount of the cargo bed of the vehicle 10 detected by the sinking amount detector 36 exceeds a predetermined threshold (sinking amount threshold) (step S31). This sinking amount threshold is preset in the controller 50 (specifically, the leveling operation end determination unit 56). The threshold is previously set in the controller 50 similarly to other thresholds described later. As described above, the "value regarding the sinking amount" may be a decrease amount (sinking amount) of the height of the container 13 (cargo bed) with respect to the ground, may be the inclination of the container 13, may be a sinking speed of the container 13, or may be a sinking acceleration of the container 13. In step S31, the value regarding the sinking amount is described as "sinking amount".

The reason why the leveling operation end condition includes the condition regarding the sinking amount, in other words, the reason why the leveling operation end position Pe illustrated in FIG. 5 is set on the basis of the sinking amount of the container 13 is as follows. As illustrated in FIG. 1, in the case where the container 13 is a cargo bed of the vehicle 10, the container 13 is pushed by the distal end attachment 25*c* via the work target object A and moves in the downward direction Z2 so as to approach the ground. In other words, when the bucket 25*c* pushes the work target object A, the container 13 sinks so as to approach the ground. For example, when the distal end attachment 25*c* further presses and levels the work target object A in a state where the work target object A is already leveled, the work machine 20 performs an unnecessary leveling operation. Further, if the distal end attachment 25*c* pushes the work target object A too much, the vehicle 10 may be damaged. Accordingly, in order to enable suppression of the occurrence of these problems, the leveling operation end condition preferably includes a condition regarding the sinking amount as described above. The sinking amount threshold is preferably set to a value that can suppress the occurrence of these problems. In order to enable suppression of the occurrence of these problems, the leveling operation end position Pe illustrated in FIG. 5 is preferably set (determined).

Here, the above Example 4A is compared with a case where the leveling operation end position Pe is set on the basis of the load acting on the distal end attachment 25*c* (see [Example 4Ba] described later). It is assumed that the load acting on the distal end attachment 25*c* increases (greatly changes) after the container 13 sinks greatly. However, when the load acting on the distal end attachment 25*c* increases, the container 13 has already sunk greatly, and the distal end attachment 25*c* may already be in a state of pressing down the work target object A too much. On the other hand, when the leveling operation end position Pe is set on the basis of the sinking amount of the container 13, it is possible to more effectively suppress the distal end attachment 25*c* from pressing down the work target object A too much.

[Example 4B] The leveling operation end condition may include a condition regarding the magnitude of the reaction force received by the distal end attachment 25*c* from the work target object A when the distal end attachment 25*c* (work machine 20) performs the leveling operation. The "condition regarding the magnitude of the reaction force" may be, for example, a condition defined by the magnitude of the reaction force or a condition defined by a value correlated with the reaction force. For example, the condition regarding the magnitude of the reaction force included in the leveling operation end condition may include a condition regarding the load acting on the distal end attachment 25*c* as described in [Example 4Ba] below, or may include a condition regarding the actual speed of the attachment 25 as described in [Example 4Bb] below.

[Example 4Ba] The leveling operation end condition may include a condition regarding a value regarding a load acting on the distal end attachment 25*c*. Hereinafter, the "value regarding a load" is simply referred to as the "value of the load". The leveling operation end condition may include a condition regarding the magnitude of the value of the load detected by the load detector 37. The leveling operation end condition may include that the value of the load detected by the load detector 37 exceeds a predetermined threshold (load threshold) (steps S41, S42, and S43). As described above, the load detector 37 may detect the value of the load acting on the attachment 25 illustrated in FIG. 1, may detect the value of the load acting on the actuator 26, or may detect the vehicle body angle of the work machine body 20*a*. For example, the leveling operation end condition may include that the value of the load (for example, stress) acting on the attachment 25 exceeds a predetermined threshold (step S41). Note that the attachment 25 is denoted as "ATT" in FIG. 7. In addition, for example, the leveling operation end condition may include that the value of the load acting on the actuator 26 (cylinder) exceeds a predetermined threshold. The leveling operation end condition may include that the value of the load acting on the distal end attachment 25*c* exceeds a predetermined threshold (step S42). In addition, the leveling operation end condition may include that the vehicle body angle of the work machine body 20*a* exceeds a predetermined threshold (step S43).

[Example 4Bb] The leveling operation end condition may include a condition regarding the actual speed of the attachment 25 (specifically, for example, a condition regarding the actual speed of the distal end attachment 25*c*). The leveling operation end condition may include a condition regarding a value regarding the actual speed of the attachment 25 acquired by the actual speed acquisition unit 57. Hereinafter, the "value regarding the actual speed" is simply referred to as an "actual speed".

[Example 4Bb-1] The leveling operation end condition may include that the actual speed of the attachment 25 is less than a predetermined threshold (actual speed threshold) (step S44). Specifically, for example, it is assumed that the distal end attachment 25*c* receives a reaction force of a certain magnitude when the distal end attachment 25*c* performs the leveling operation, and the actual speed of the distal end attachment 25*c* is equal to or more than the actual speed threshold. Thereafter, when the reaction force received by the distal end attachment 25*c* increases, the actual speed of the distal end attachment 25*c* becomes less than the actual speed threshold. At this time, the controller 50 ends (stops) the leveling operation.

[Example 4Bb-2] The leveling operation end condition may include a condition regarding a deviation amount of the actual speed of the attachment 25 from a target speed. For example, the leveling operation end condition may include that the deviation amount exceeds a predetermined threshold (deviation amount threshold). The target speed of the attachment 25 is set in the work plan setting unit 53. Specifically, for example, it is assumed that the distal end attachment 25*c* receives a reaction force of a certain magnitude when the distal end attachment 25*c* performs the leveling operation, and the deviation amount is equal to or less than the deviation amount threshold. Thereafter, when the reaction force received by the distal end attachment 25*c* increases, the actual speed decreases with respect to the target speed of the distal end attachment 25*c*, and the deviation amount exceeds the deviation amount threshold. At this time, the controller 50 ends (stops) the leveling operation.

[Example 5] The leveling operation end position Pe illustrated in FIG. 5 may be a position determined even if the leveling operation is not performed at the place corresponding to the position P1, that is, a position that can be determined before the leveling operation is performed.

[Example 5A] The leveling operation end position Pe may be set on the basis of information (for example, the shape of the work target object A) of the work target object A detected by the work target object detector 34.

[Example 5Aa] The leveling operation end position Pe corresponding to the position P1 may be set at a position that is lower in the downward direction Z2 than a top portion that is the next highest to the first top portion A1 corresponding to the position P1, that is, than the second top portion A2 corresponding to the position P2. Specifically, on the basis of the detection result of the work target object detector 34, the controller 50 specifies the highest first top portion A1 of the work target object A in the container 13 and the second top portion A2 that is the next highest to the first top portion A1 of the work target object A in the container 13. The controller 50 causes the work machine 20 to perform the leveling work on the first top portion A1 so that the work target object A on the first top portion A1 becomes lower than the second top portion A2. Thus, the height of the highest portion of the work target object A in the container 13 is reliably lowered.

[Example 5Ab] The leveling operation end position Pe corresponding to the position P1 may be set on the basis of the height of the first top portion A1 corresponding to the position P1. For example, the leveling operation end position Pe may be a position lower than the height of the first top portion A1 by a predetermined press-down amount. The predetermined press-down amount may be set by manual operation of the worker (for example, input of information to the operation unit 41 by the worker), or may be automatically set by the controller 50.

[Example 5B] The leveling operation end position Pe may be set on the basis of information (for example, the position of the container 13, the shape of the container 13, and the like) of the container 13 detected by the container detector 33. For example, the leveling operation end position Pe may be set on the basis of the height of the container 13, for example, may be set on the basis of the height of the container wall surface 13*b* (for example, the height of the tail gate plate surface 13*b*1 or the height of the side gate panel surface 13*b*2). The leveling operation end position Pe may be set on the basis of the height of the container floor surface 13*a*. [Example 5C] The leveling operation end position Pe may be set by manual operation of the worker (for example, input of information to the operation unit 41 by the worker).

(Target Position Next to Leveling Operation End Position Pe)

For example, when the controller 50 moves the distal end attachment 25*c* from the leveling operation start position Ps to the leveling operation end position Pe at the location corresponding to the target position P1, the controller ends the leveling operation at the place corresponding to the position P1 (step S51). Thereafter, the controller 50 may move (return) the distal end attachment 25*c* to, for example, the same position as the leveling operation start position Ps corresponding to the position P1. Thereafter, the controller 50 may move the distal end attachment 25*c* to the leveling operation start position Ps corresponding to the next target position P2. In addition, after moving the distal end attachment 25*c* from the leveling operation start position Ps to the leveling operation end position Pe at the place corresponding to the target position P1, the controller 50 may move the distal end attachment 25*c* to a position different from the leveling operation start position Ps corresponding to the target position P1, for example, the leveling operation start position Ps corresponding to the next target position P2.

Summary of First Embodiment

A configuration of the work system 1 according to the first embodiment illustrated in FIGS. 1 to 7 and an effect obtained by the configuration are as follows.

The work system 1 according to the first embodiment is a system for automatically operating the work machine 20 including the attachment 25 (work device 25). The work system 1 includes the controller 50 that controls an operation of the work machine 20 so that a leveling work is performed, the leveling work including a leveling operation in which the work target object A that has been loaded into the container 13 by a loading work is leveled using the work device 25. The controller 50 acquires information regarding at least one of the work target object A in the container 13, the container 13, and the work machine 20, and determines at least one of a start position of the leveling operation and an end position of the leveling operation by using the information. Specifically, the information acquired by the detection result acquisition unit 50*a* of the controller 50 includes information regarding at least one of a state of the work target object A in the container 13, a state of the container 13, and a state of the work machine 20, and the controller 50 controls the operation of the work machine 20 so that the leveling operation is performed using at least one of the start position and the end position that has been determined. Therefore, the work system 1 can cause the work machine 20 to efficiently perform the leveling work by automatic operation. The outline of the work system 1 according to the first embodiment is as described above.

Hereinafter, specific configurations of the work system 1 according to the first embodiment and effects obtained thereby will be summarized.

In the work system 1 according to the first embodiment, the work device 25 includes the distal end attachment 25*c*. The work system 1 includes the detection result acquisition unit 50*a* and the automatic operation control unit 59.

[Configuration 1-1] The detection result acquisition unit 50*a* acquires a detection result of a state of at least one of the work target object A in the container 13, the container 13, and the work machine 20.

[Configuration 1-2] The automatic operation control unit 59 determines at least one of a start position (leveling operation start position Ps) and an end position (leveling operation end position Pe) of the leveling operation illustrated in FIG. 5 on the basis of the detection result acquired by the detection result acquisition unit 50*a*. The "leveling operation" is an operation of leveling the work target object A in the container 13 with the distal end attachment 25*c*. The automatic operation control unit 59 causes the work machine 20 to perform the leveling operation by automatic operation on the basis of the determined position.

In [Configuration 1-2] above, at least one of the start position (leveling operation start position Ps) and the end position (leveling operation end position Pe) of the leveling operation is determined on the basis of the detection result acquired by the detection result acquisition unit 50*a*. As in [Configuration 1-1] above, this detection result is a detection result of the state of at least one of the work target object A in the container 13, the container 13, and the work machine 20. Thus, the automatic operation control unit 59 can automatically set at least one of the start position (leveling operation start position Ps) and the end position (leveling operation end position Pe) of the leveling operation to an appropriate position according to the detection result. Therefore, the work system 1 can cause the work machine 20 to efficiently perform the leveling work by automatic operation.

The detection result acquisition unit 50*a* acquires a detection result of the state of the work target object A.

[Configuration 2] The automatic operation control unit 59 of the controller 50 may determine a high portion of the work target object A in the container 13 as the start position by using the information regarding the state of the work target object A, and control an operation of the work machine 20 so that the leveling operation is started from the high portion. For example, on the basis of the detection result acquired by the detection result acquisition unit 50*a*, the automatic operation control unit 59 causes the work machine 20 to perform a leveling operation so as to level the work target object A in the container 13 in order from a high portion.

In [Configuration 2] above, a portion where the height of the work target object A is high (for example, the first top portion A1) is crushed by being leveled by the distal end attachment 25*c*. Then, the crushed work target object A flows (collapses) to a portion where the height of the work target object A is low. Thus, a portion where the work target object A is high in the container 13 becomes lower, and a portion where the work target object A is low in the container 13 becomes higher. At this time, the work target object A can be brought close to a flat state in a wider range than the portion leveled by the distal end attachment 25*c*. Thus, the working time of the leveling work can be shortened. Therefore, the work system 1 can cause the work machine 20 to perform the leveling work by automatic operation more efficiently.

In addition, in the first embodiment, the controller 50 may determine whether or not to end the leveling operation by using the information. Specifically, in the case where the container 13 is the cargo bed of the vehicle 10, the information regarding the state of the container 13 may include information regarding a decrease amount (sinking amount) of the height of the cargo bed with respect to the ground, and the controller 50 may determine the end position by using the information regarding the decrease amount (sinking amount). That is, the controller 50 may determine whether or not to end the leveling operation by using the information regarding the decrease amount (the sinking amount).

More specifically, the detection result acquisition unit 50*a* acquires a detection result regarding a decrease amount (sinking amount) of the height of the cargo bed, which is the container 13 illustrated in FIG. 5, with respect to the ground.

[Configuration 3] The condition (leveling operation end condition) under which the automatic operation control unit 59 causes the distal end attachment 25*c* to end the leveling operation includes a condition regarding the sinking amount of the container 13 (cargo bed) acquired by the detection result acquisition unit 50*a* (see step S31 in FIG. 7).

The following effects can be obtained by [Configuration 3] above. In a state where the container 13 as the cargo bed sinks greatly, the work target object A may already be leveled. Even if the distal end attachment 25*c* further levels the work target object A in this state, the work machine 20 performs unnecessary work, and the vehicle 10 including the container 13 may be damaged. Therefore, according to [Configuration 3] above, it is possible to suppress the unnecessary leveling operation of the work target object A by the distal end attachment 25*c* in the state where the container 13 as the cargo bed sinks greatly. Thus, the work system 1 can cause the work machine 20 to more efficiently perform the leveling work by automatic operation. Further, according to [Configuration 3] above, it is possible to suppress the damage of the vehicle 10 including the container 13 (cargo bed).

In addition, in the first embodiment, the information regarding the state of the work machine 20 includes information regarding a reaction force received by the attachment 25 from the work target object A when the leveling operation using the attachment 25 (work device 25) is performed, and the controller 50 may determine the end position by using the information regarding the reaction force. That is, the controller 50 may determine whether or not to end the leveling operation using the information regarding the reaction force.

[Configuration 4] More specifically, the detection result acquisition unit 50*a* acquires the detection result regarding the reaction force received by the distal end attachment 25*c* from the work target object A when the work machine 20 performs the leveling operation. The condition under which the automatic operation control unit 59 ends the leveling operation (leveling operation end condition) includes the above condition regarding the magnitude of the reaction force (see steps S41, S42, and S43 in FIG. 7).

According to [Configuration 4] above, it is possible to determine whether or not the leveling operation end condition is satisfied without acquiring (detecting) the state of the container 13 which is the cargo bed. Thus, the configuration of the detection unit 30 for acquiring the state of the container 13 can be simplified.

In addition, in the first embodiment, the leveling operation is a first leveling operation of leveling the work target object A by using the attachment 25 (work device 25) in a first leveling range, the leveling work may further include a second leveling operation of leveling the work target object A by using the attachment 25 in a second leveling range, and the controller 50 may control the operation of the work machine 20 so that a part of the second leveling range overlaps the first leveling range when viewed from above.

More specifically, the automatic operation control unit 59 causes the distal end attachment 25*c* to perform a plurality of leveling operations. As illustrated in FIG. 6, when the container 13 is viewed from above, a range in which the distal end attachment 25*c* levels the work target object A in one leveling operation is referred to as a leveling operation range Q.

[Configuration 5] While changing the leveling operation range Q, the automatic operation control unit 59 causes the work machine 20 to perform the leveling operation a plurality of times so that parts of the adjacent leveling operation ranges Q overlap with each other (so that the lap portion Q1 is provided).

According to [Configuration 5] above, even when the work target object A is pushed out around the distal end attachment 25*c* by the leveling operation, the distal end attachment 25*c* can press and level the pushed out work target object A. Thus, the work system 1 can cause the work machine 20 to perform the leveling operation so as to level the work target object A more flatly as compared with the case where [Configuration 5] above is not provided.

In addition, in the first embodiment, the controller 50 may specify the first top portion A1 that is a highest portion of the work target object A in the container 13 and the second top portion A2 that is the next highest portion after the first top portion A1 of the work target object A in the container 13 by using information regarding the state of the work target object A in the container 13, and the leveling operation may be an operation of leveling a portion including the first top portion A1 so that the portion including the first top portion A1 becomes lower than the second top portion A2.

[Configuration 6] More specifically, the automatic operation control unit 59 specifies first top portion A1 and second top portion A2 illustrated in FIG. 5 on the basis of the detection result acquired by the detection result acquisition unit 50*a*. The first top portion A1 is the highest portion of the work target object A in the container 13. The second top portion A2 is the next highest portion after the first top portion A1 of the work target object A in the container 13. The automatic operation control unit 59 causes the work machine 20 to perform the leveling operation on the first top portion A1 so that the work target object A on the first top portion A1 becomes lower than the second top portion A2.

As described in [Configuration 6] above, by performing the leveling operation on the first top portion A1, the portion of the highest first top portion A1 of the work target object A in the container 13 becomes lower than the second top portion A2. Thus, after the leveling operation in the first top portion A1 corresponding to the position P1 is completed, the height of the highest portion of the work target object A in the container 13 can be reliably lowered.

[Configuration 7] The detection result acquisition unit 50*a* acquires a detection result of a state of at least one of the cargo bed which is the container 13 and the work machine 20. When a condition (leveling operation end condition) regarding the detection result acquired by the detection result acquisition unit 50*a* is satisfied while the work machine 20 is performing the leveling operation, the automatic operation control unit 59 causes the work machine 20 to end the leveling operation.

According to [Configuration 7] above, the leveling operation can be ended in an appropriate state according to the detection result of the state of at least one of the cargo bed which is the container 13 and the work machine 20. The automatic operation control unit 59 can automatically set the end position of the leveling operation (leveling operation end position Pe) at an appropriate position according to the detection result. Therefore, the work system 1 can cause the work machine 20 to efficiently perform the leveling work by automatic operation.

[Configuration 9] As illustrated in FIG. 1, the work system 1 includes the work machine 20. The detection result acquisition unit 50*a* and the automatic operation control unit 59 are mounted on the work machine 20. That is, in the first embodiment, the controller 50 may include an acquisition unit (detection result acquisition unit 50*a*) that acquires the information, and an automatic operation control unit 59 that determines at least one of the start position and the end position by using the information, and controls the operation of the work machine 20 so that the leveling operation is performed using at least one of the start position and the end position that has been determined, and the detection result acquisition unit 50*a* and the automatic operation control unit 59 may be mounted on the work machine 20. The same applies to the work system 1 according to the second embodiment described later.

According to [Configuration 9] above, the components of the work system 1 do not have to be provided outside the work machine 20.

Modification of First Embodiment

The above first embodiment may be variously modified. For example, the number of components of the above embodiment may be changed, and some of the components do not have to be provided. For example, the connection of the components illustrated in FIG. 3 or the like may be changed. For example, a plurality of members and parts different from each other may be described as one member and part. For example, what has been described as one member and part may be divided into a plurality of different members and parts. Specifically, for example, the components (the work plan setting unit 53, the automatic operation control unit 59, and the like) of the controller 50 may be separately provided. For example, various parameters (setting value, threshold, range, and the like) may be preset in the controller 50, or may be directly set by manual operation of the worker (for example, operation of the operation unit 41, teaching, or the like). Various parameters may be calculated by the controller 50 on the basis of information set by manual operation of the worker, or may be calculated by the controller 50 on the basis of information detected by the detection unit 30. For example, the various parameters may not be changed, may be changed by manual operation, or may be automatically changed by the controller 50 according to some condition. For example, some of the steps in the flowcharts illustrated in FIGS. 4 and 7 may not be performed. For example, the components each may have only some of features (function, arrangement, shape, manufacturing method, operation, and the like).

Second Embodiment

Next, a work system according to a second embodiment of the present invention will be described.

The problem to be solved by the work system according to the second embodiment is that a work machine efficiently switches between a work of loading a work target object into a container by the work machine and a work of leveling the work target object that has been loaded into the container by the work machine.

The work system according to the second embodiment includes a work machine and a controller, the work machine including a bucket, the controller causing the work machine to automatically operate. The controller causes the work machine to perform a loading work and a leveling work. The loading work is a work of loading a work target object into a container by the bucket. The leveling work is a work of leveling the work target object that has been loaded into the container with the bucket after the loading work is finished. The controller stores a position where the bucket is arranged at the end of the loading work as a loading end position. The controller causes the work machine to start the leveling work in a loading end position side region within a range of the container when viewed from above.

The work system according to the second embodiment can efficiently switch work when the work of the work machine by automatic operation is changed from the loading work to the leveling work.

A work system 1 according to the second embodiment will be described with reference to FIGS. 8 to 13.

Figure 8:
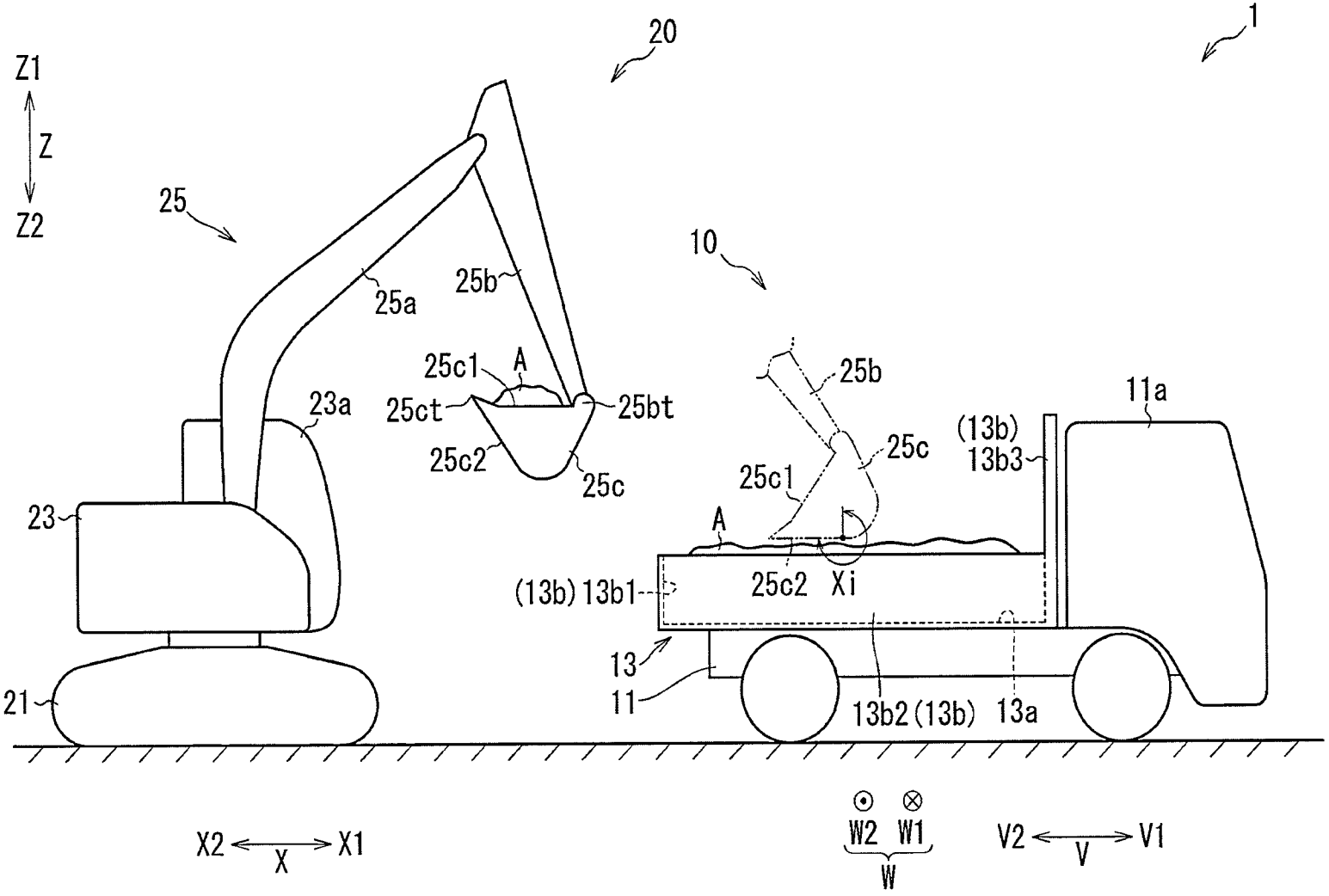
FIG. 8 is a view of a vehicle and a work machine of a work system according to a second embodiment of the present invention as viewed from a side.

As illustrated in FIG. 8, the work system 1 is a system in which a work machine 20 performs work on a container 13. The work system 1 includes a vehicle 10, a work machine 20, a detection unit 30 illustrated in FIG. 10, an operation unit 41, and a controller 50.

As illustrated in FIG. 8, the vehicle 10 is a machine (transport vehicle) that transports a transported object (work target object A) stored in the container 13. The vehicle 10 is, for example, a dump truck or the like. The vehicle 10 includes a vehicle body 11 and a container 13. The configurations of the vehicle body 11 and the container 13 illustrated in FIG. 8 are similar to the configurations of the vehicle body 11 and the container 13 in the first embodiment described with reference to FIG. 1 and the like, and thus detailed description thereof will be omitted.

The work machine 20 is a machine that performs work. The work machine 20 is a machine that performs a loading work and a leveling work. The work machine 20 is, for example, a construction machine that performs construction work, and is, for example, an excavator. The work machine 20 is configured to be operable by automatic operation. That is, the work machine 20 is automated so as to operate on the basis of a command input from the controller 50. The work machine 20 may be operable on the basis of an operation by a worker (operator) in the cab 23*a*, or may be configured to operate on the basis of a remote operation by an operator at a remote location away from the work machine 20.

Figure 9:
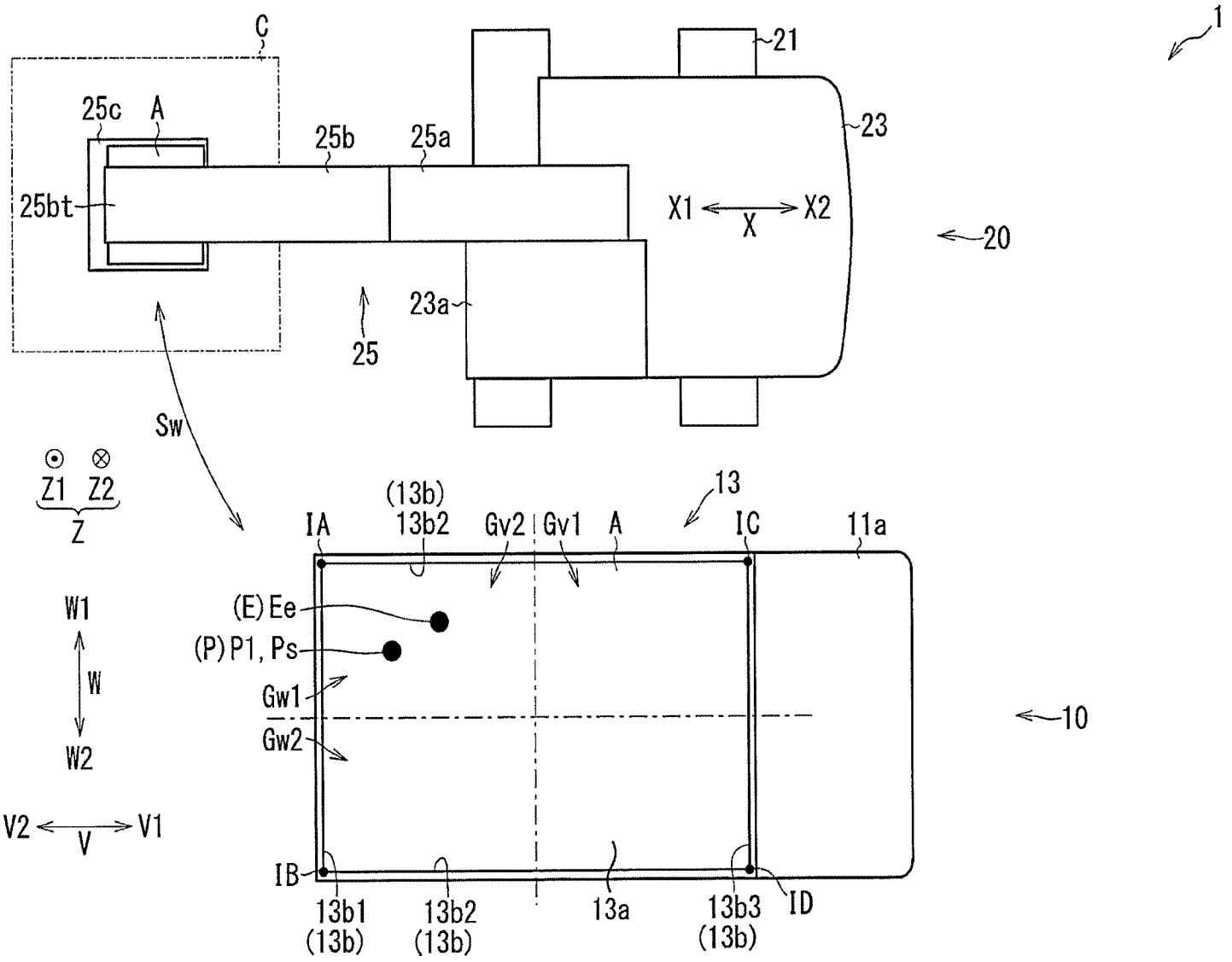
FIG. 9 is a view of a vehicle and a work machine arranged in a layout different from an example illustrated in FIG. 8 as viewed from above.
Figure 10:
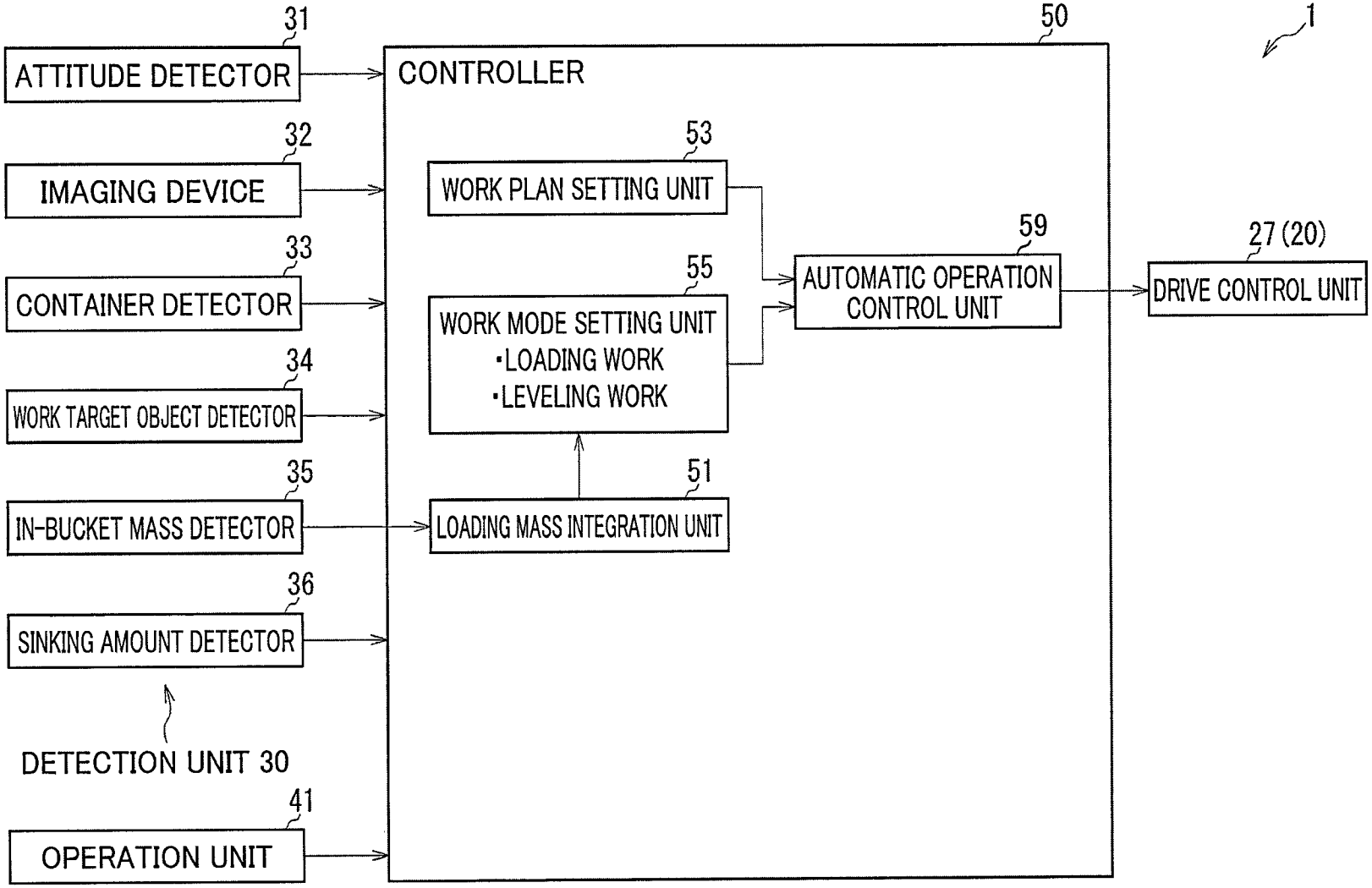
FIG. 10 is a block diagram of the work system according to the second embodiment.

The work machine 20 includes a lower travelling body 21, an upper slewing body 23, an attachment 25, and a drive control unit 27. The configurations of the lower travelling body 21, the upper slewing body 23, the attachment 25, and the drive control unit 27 illustrated in FIGS. 8 to 10 are similar to the configurations of the lower travelling body 21, the upper slewing body 23, the attachment 25, and the drive control unit 27 in the first embodiment described with reference to FIGS. 1 to 3 and the like, and thus detailed description thereof will be omitted. Note that, also in the second embodiment, the distal end attachment 25*c* is a bucket 25*c*. Further, the leveling surface 25*c*2 in the first embodiment is referred to as a bucket distal end back surface 25*c*2 in the second embodiment, and the distal end attachment distal end portion 25*ct* in the first embodiment is referred to as a bucket distal end portion 25*ct* in the second embodiment.

The work target object A in the second embodiment is an object to be worked by the work machine 20, similarly to the work target object A in the first embodiment. The work target object A is captured by the bucket 25*c* in a capturing phase, is released from the bucket 25*c* in a release phase, and is loaded into the container 13. The work target object A is leveled by the bucket 25*c*. The work target object A is earthy, granular, chip-like, powdery, massive, or the like. For example, the work target object A may be soil, stone, wood, metal, or waste.

The drive control unit 27 controls a plurality of actuators for driving the work machine 20. The plurality of actuators in the second embodiment are similar to the plurality of actuators 26 in the first embodiment. The drive control unit 27 controls a slewing motor that slews the upper slewing body 23 with respect to the lower travelling body 21. The drive control unit 27 controls a boom cylinder that raises and lowers the boom 25*a* with respect to the upper slewing body 23. The drive control unit 27 controls an arm cylinder that rotates the arm 25*b* with respect to the boom 25*a*. The drive control unit 27 controls a bucket cylinder (distal end attachment cylinder) that rotates the bucket 25*c* with respect to the arm 25*b*.

The detection unit 30 detects various states in the work system 1. The detection unit 30 illustrated in FIG. 10 outputs a detection value to the controller 50. The detection unit 30 includes an attitude detector 31, an imaging device 32, a container detector 33, a work target object detector 34, an in-bucket mass detector 35 (loading mass detector 35), and a sinking amount detector 36. The configurations of the attitude detector 31, the imaging device 32, the container detector 33, the work target object detector 34, the in-bucket mass detector 35 (loading mass detector 35), and the sinking amount detector 36 in the second embodiment are similar to the configurations of the attitude detector 31, the imaging device 32, the container detector 33, the work target object detector 34, the loading mass detector 35, and the sinking amount detector 36 in the first embodiment, and thus detailed descriptions thereof will be omitted.

Note that, although not illustrated in the second embodiment, as in the first embodiment, the attitude detector 31 may include a boom attitude sensor that detects information (angle, angular speed, angular acceleration, or the like) of the rotation of the boom 25*a* with respect to the upper slewing body 23. The attitude detector 31 may include an arm attitude sensor that detects information of the rotation of the arm 25*b* with respect to the boom 25*a*. The attitude detector 31 may include a bucket attitude sensor (distal end attachment attitude sensor) that detects information of the rotation of the bucket 25*c* with respect to the arm 25*b*.

The operation unit 41 is used by a worker to input information. The configuration of the operation unit 41 illustrated in FIG. 10 is similar to the configuration of the operation unit 41 in the first embodiment described with reference to FIG. 3, and thus the detailed description thereof will be omitted.

The controller 50 in the second embodiment is similar to the controller 50 in the first embodiment. That is, the controller 50 includes a computer that inputs and outputs signals, performs arithmetic (processing), stores information, and the like. For example, the function of the controller 50 is implemented by causing an arithmetic unit to execute a program stored in a storage unit of the controller 50. For example, the controller 50 receives a detection result from the detection unit 30. For example, the controller 50 performs control to cause the work machine 20 to automatically operate. The controller 50 is an automatic operation controller. For example, the controller 50 outputs a command for operating the work machine 20. The controller 50 includes a loading mass integration unit 51, a work plan setting unit 53, a work mode setting unit 55, and an automatic operation control unit 59.

The controller 50 in the second embodiment does not have to include the detection result acquisition unit 50*a*, the leveling operation end determination unit 56, and the actual speed acquisition unit 57 of the controller 50 in the first embodiment. However, the controller 50 in the second embodiment may have functions similar to those of the detection result acquisition unit 50*a*, the leveling operation end determination unit 56, and the actual speed acquisition unit 57 of the controller 50 in the first embodiment.

The functions of the loading mass integration unit 51, the work plan setting unit 53, the work mode setting unit 55, and the automatic operation control unit 59 in the second embodiment illustrated in FIG. 10 are similar to the functions of the loading mass integration unit 51, the work plan setting unit 53, the work mode setting unit 55, and the automatic operation control unit 59 in the first embodiment described with reference to FIG. 3, and thus detailed description thereof will be omitted.

(Operation)

The work system 1 according to the second embodiment is configured to operate as follows. An outline of the operation of the work system 1 is as follows. The controller 50 causes the work machine 20 to perform a loading work and a leveling work by automatic operation. Specifically, the work plan setting unit 53 sets a work plan for the loading work and the leveling work. The work mode setting unit 55 sets (selects) a mode of the loading work or a mode of the leveling work. The automatic operation control unit 59 operates the work machine 20 according to the work plan corresponding to the mode set in the work mode setting unit 55. As a result, the work machine 20 operates by automatic operation according to the work plan.

(Arrangement of Work Machine 20 with Respect to Container 13)

In the second embodiment illustrated in FIG. 8, similarly to the first embodiment described with reference to FIG. 1, the work machine 20 may be arranged at various relative positions with respect to the container 13. For example, the work machine 20 may be arranged so as to face the container 13 in the container forward/rearward direction V. In the example illustrated in FIG. 8, the work machine 20 is arranged in the container rearward direction V2 with respect to the container 13. For example, as illustrated in FIG. 9, the work machine 20 may be arranged so as to face the container 13 in the container width direction W. In the example illustrated in FIG. 9, the work machine 20 is arranged in the container leftward direction W1 with respect to the container 13. The work machine 20 may be arranged in the container rightward direction W2 with respect to the container 13. Hereinafter, a case where the work machine 20 is arranged so as to face the container 13 in the container width direction W will be mainly described. Hereinafter, the controller 50 will be described with reference to FIG. 10, and steps S10 to S22 illustrated in FIG. 11 will be described with reference to FIG. 11.

(Loading Work)

Figure 11:
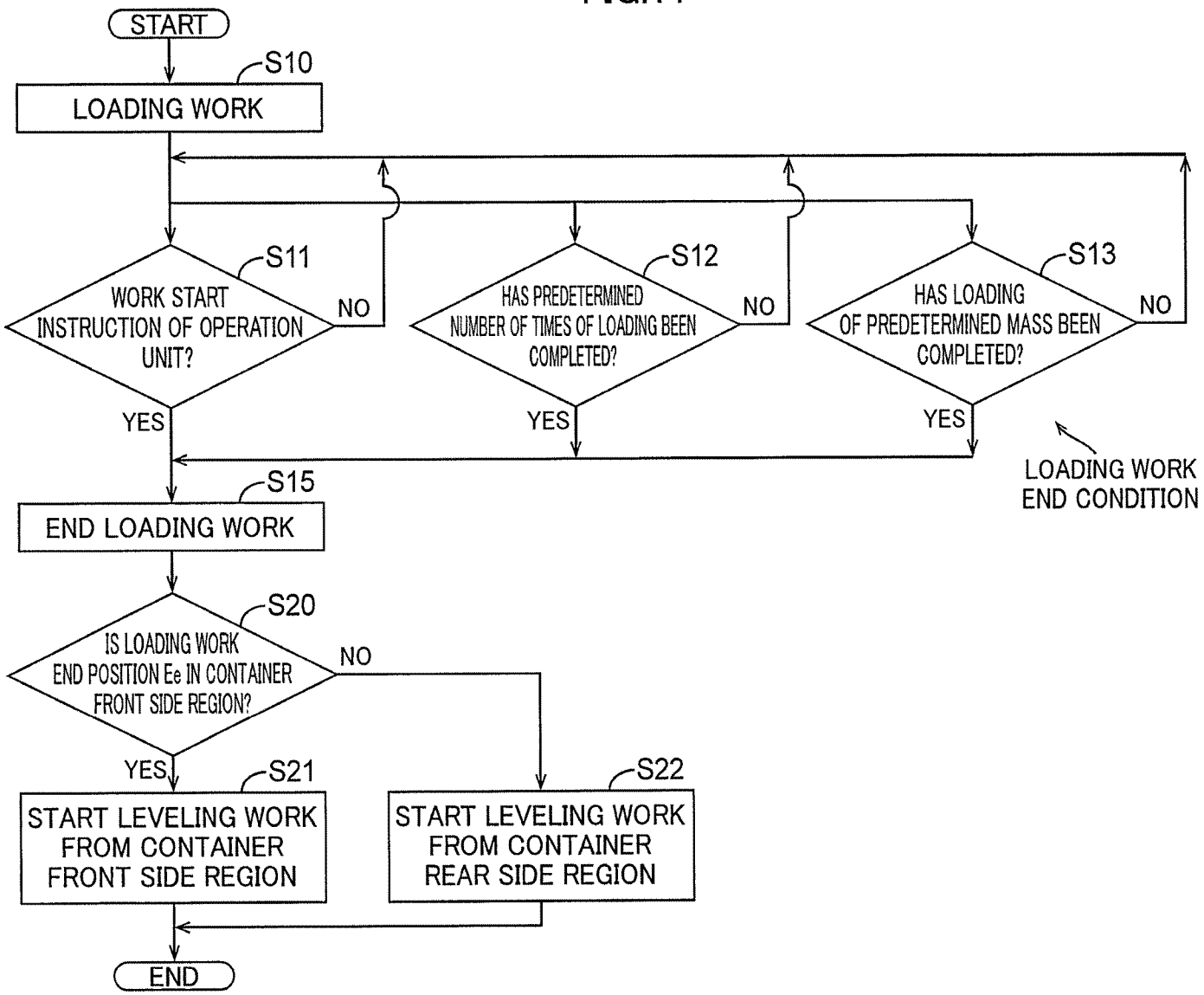
FIG. 11 is a flowchart illustrating processing by a controller of the work system according to the second embodiment.

The controller 50 causes the work machine 20 illustrated in FIG. 9 to perform the loading work by automatic operation (step S10 in FIG. 11). The loading work is a work of loading the work target object A into the container 13 by the bucket 25*c*. A specific example of the loading work is as follows. The loading work includes a plurality of work phases (work contents). For example, the plurality of work phases includes a capturing phase, a lifting slewing phase, a release phase, and a return slewing phase. The capturing phase is a phase in which the bucket 25*c* captures the work target object A in the target capturing range C (for example, excavates earth and sand). For example, the target capturing range C may be set at a place where the work target object A is collected (for example, a soil sand pile, a soil pit, and the like), or may be set on the ground as an excavation object. The lifting slewing phase is a phase in which the bucket 25*c* moves from the target capturing range C toward a position immediately above the container 13 in a state where the bucket 25*c* captures the work target object A. In the lifting slewing phase, the bucket 25*c* moves in the machine slewing direction Sw and the upward/downward direction Z (mainly the upward direction Z1). The release phase is a phase in which the bucket 25*c* releases (for example, discharges) the work target object A immediately above the container 13 (loading position E). The return slewing phase is a phase in which the bucket 25*c* moves from the position immediately above the container 13 toward the target capturing range C. In the return slewing phase, the bucket 25*c* moves in the machine slewing direction Sw and the upward/downward direction Z (mainly the downward direction Z2). In the loading work, a series of work phases including the capturing phase, the lifting slewing phase, the release phase, and the return slewing phase is repeatedly performed.

(Loading Position E)

In the loading work, a position (loading position E) at which the work target object A is loaded from the bucket 25*c* into the container 13 can be variously set. For example, the loading position E may be different in each of the plurality of release phases, or may be the same position until a certain condition is satisfied. [Example 1A] For example, the loading position E may be changed in order in a predetermined direction. That is, the loading positions E of the plurality of release phases may be changed so as to be shifted in a predetermined direction as the number of times increases. [Example 1Aa] For example, the loading position E may be changed in order in the container forward/rearward direction V (longitudinal direction of the container 13). For example, the loading position E may be changed in order in the container forward direction V1 or in order in the container rearward direction V2. For example, the loading position E may be changed in order in the container width direction W. For example, the loading position E may be changed in order in the container rightward direction W2 or may be changed in order in the container leftward direction W1. For example, the loading position E may be changed in order in the machine slewing direction Sw. For example, the loading position E may be changed in order in the machine forward/rearward direction X. [Example 1Ab] For example, the loading position E may be changed in order from a position close to one end of the container 13 toward a position close to the other end (an end opposite to the one end). [Example 1B] The loading position E does not have to be changed in order in a predetermined direction, and may be randomly changed. However, the method of setting the loading position E is not limited to the above specific example.

(Loading Work End Condition)

In the controller 50 (specifically, the work mode setting unit 55), a loading work end condition is set in advance (before the determination of the end of the loading work is performed). The loading work end condition is a condition for ending the loading work on the work machine 20. The loading work end condition is also a condition (leveling work start condition) for causing the work machine 20 to start the leveling work. The loading work end condition can be set variously. The loading work end condition may include only one condition, or may include a plurality of conditions as illustrated in FIG. 11. When the loading work end condition includes a plurality of conditions, the controller 50 may end the loading work when at least one of the plurality of conditions included in the loading work end condition is satisfied, or may end the loading work when two or more (for example, all) of the plurality of conditions included in the loading work end condition are satisfied. A specific example of the loading work end condition is as follows.

(Operation of Operation Unit 41 or the Like)

The loading work end condition may include that a command to end the loading work is output. The loading work end condition may include that a command to start the leveling work is output. The loading work end condition may include that a command to change the work mode from the loading work mode to the leveling work mode is output. For example, the loading work end condition may include that the above command is output from the operation unit 41 (see FIG. 3) (step S11 in FIG. 11). Note that the loading work end condition may include that a command to end the loading work (a command not depending on an operation by the worker) is output from an element other than the operation unit 41.

(Number of Times of Loading Work or the Like)

The loading work end condition may include that the number of times of loading from the bucket 25*c* to the container 13 illustrated in FIG. 9 (the number of times of performing the series of phases) has reached a predetermined number of times (number threshold) (step S12 in FIG. 11). [Example 2A] The number threshold may be set by manual operation of the worker (input of information to the operation unit 41 by the worker). [Example 2Aa] For example, a value of the number of times that is the number threshold may be set by the operation unit 41. [Example 2Ab] For example, information for setting the number threshold may be set by the operation unit 41, and the controller 50 may calculate the number threshold on the basis of the information set by the operation unit 41. Specifically, for example, the controller 50 may calculate the number threshold on the basis of manually set information (dimensions and the like) of the container 13. [Example 2B] The number threshold may be automatically set by the controller 50. For example, the controller 50 may calculate the number threshold on the basis of the information of the container 13 detected by the container detector 33. [Example 2C] The number threshold may be an initial value, a fixed value, or the like preset in the controller 50.

Various setting values (such as a threshold and an adjustment value) other than the number threshold may be manually set by the worker, may be automatically calculated by the controller 50, or may be values preset in the controller 50.

(Integrated Loading Mass)

The loading work end condition may include that the mass of the work target object A loaded into the container 13 in the loading work has reached a target value (integrated loading mass threshold) (step S13 in FIG. 11). More specifically, the loading work end condition may include that the value calculated by the loading mass integration unit 51 (see FIG. 3) has reached the integrated loading mass threshold (has become equal to or more than the integrated loading mass threshold).

(End of Loading Work)

When the loading work end condition is satisfied, the controller 50 causes the work machine 20 to end the loading work (step S15 in FIG. 11). More specifically, when the loading work end condition is satisfied and the bucket 25*c* completes the release of the work target object A, the controller 50 causes the work machine 20 to end the loading work. For example, when the loading work end condition is satisfied during the return slewing phase, the capturing phase, or the lifting slewing phase, the controller 50 causes the work machine 20 to perform the loading work until the bucket 25*c* completes the release of the work target object A. Further, in the release phase, when the loading work end condition is satisfied in a state where the bucket 25*c* has not completed the release of the work target object A, the controller 50 causes the work machine 20 to perform the loading work until the bucket 25*c* completes the release of the work target object A. When ending the loading work, the automatic operation control unit 59 outputs a command to end the loading work to the drive control unit 27. As a result, the work machine 20 ends the loading work.

Figure 12:
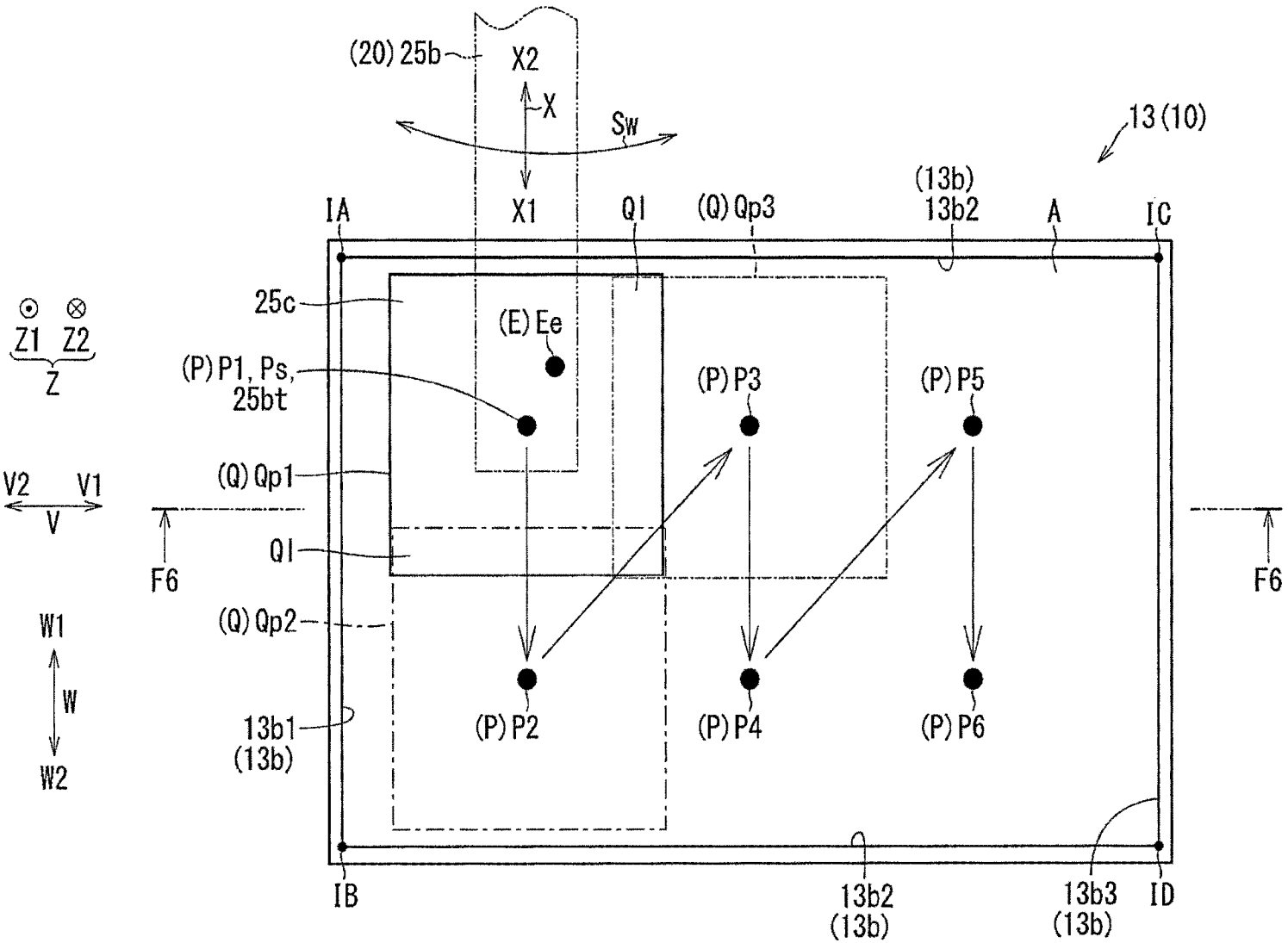
FIG. 12 is a view of a cargo bed (container) of a vehicle and a target path of a leveling work of the work system according to the second embodiment as viewed from above.

The controller 50 sets the position where the bucket 25*c* is arranged at the end of the loading work as the loading end position Ee. The loading end position Ee is a position of the bucket 25*c* when the bucket 25*c* releases the work target object A at the end of the loading work. In other words, the loading end position Ee is the position of the bucket 25*c* when the bucket 25*c* releases the work target object A before the start of the leveling work and in the last release phase. The position of the bucket 25*c* corresponding to the loading end position Ee is a position of a specific portion set in advance in the bucket 25*c*. This specific portion may be, for example, a proximal end portion of the bucket 25*c* (a portion corresponding to the arm distal end portion 25*bt*), the bucket distal end portion 25*ct*, or another portion of the bucket 25*c*. Note that, in FIG. 9, the loading end position Ee is indicated by a point denoted by a reference sign "Ee". In FIGS. 9 and 12, the plurality of target positions (target positions P1 to P6) included in a target path P of the leveling work is indicated by points denoted by reference signs "P1", "P2", . . . , "P6". Each of these points indicates a target position of the arm distal end portion 25*bt* as a specific portion of the attachment 25, that is, a target position of the proximal end portion of the bucket.

(Leveling Work)

After completion of the loading work, the controller 50 causes the work machine 20 illustrated in FIG. 9 to start the leveling work. The leveling work is a work of leveling the work target object A loaded into the container 13 with the bucket 25*c*. The position of the bucket 25*c* when the leveling work is started is referred to as a leveling work start position Ps. After completion of the loading work, the controller 50 moves the bucket 25*c* from the loading end position Ee to the leveling work start position Ps.

(Movement from Loading End Position Ee to Leveling Work Start Position Ps)

At this time, the controller 50 preferably moves the bucket 25*c* from the loading end position Ee to the leveling work start position Ps through a path that can suppress an unnecessary operation of the attachment 25. For example, the path of the arm distal end portion 25*bt* when the bucket 25*c* moves from the loading end position Ee to the leveling work start position Ps may be a straight line or an approximately straight line.

The leveling work start position Ps is preferably set so as to suppress an unnecessary operation of the attachment 25. Specifically, the leveling work start position Ps is set in a loading end position side region in the range of the container 13 when the container 13 is viewed from above. The controller 50 causes the work machine 20 to start the leveling work at the leveling work start position Ps set in the loading end position side region (see steps S20, S21, and S22 in FIG. 11). Thus, it is possible to suppress an increase in the moving distance of the bucket 25*c* from the loading end position Ee to the leveling work start position Ps, and it is possible to shorten the work time.

The above-described "loading end position side region" is a region including the loading end position Ee out of two regions obtained by dividing the internal region of the container 13 when the container 13 is viewed from above into two equal parts in a predetermined direction as illustrated in FIG. 9. The "predetermined direction" may be, for example, the container forward/rearward direction V or the container width direction W. The "predetermined direction" may be, for example, the machine slewing direction Sw or the machine forward/rearward direction X. Note that when the loading end position Ee exists at the boundary between the two regions, the leveling work start position Ps may be either of the two regions. In such a case, which region the leveling work start position Ps is determined may be preset in the controller 50.

[Example 3A] For example, in a case where the container 13 has a shape (for example, a rectangle) having a longitudinal direction when viewed from above, the leveling work start position Ps is determined as follows. The leveling work start position Ps is set in the loading end position side region including the loading end position Ee out of two regions obtained by dividing the internal region of the container 13 when viewed from above into two equal parts in the longitudinal direction of the container 13. Then, the controller 50 causes the work machine 20 to start the leveling work at the leveling work start position Ps set in the loading end position side region. Specifically, for example, two regions obtained by dividing the internal region of the container 13 when viewed from above into two equal parts in the container forward/rearward direction V include a container front side region Gv1 which is a region located in the container forward direction V1 and a container rear side region Gv2 which is a region located in the container rearward direction V2. In a case where the loading end position Ee is included in the container front side region Gv1 (YES in step S20 in FIG. 11), the loading end position side region is the container front side region Gv1, and the leveling work start position Ps is set in the container front side region Gv1 (step S21 in FIG. 11). In a case where the loading end position Ee is included in the container rear side region Gv2 (NO in step S20 in FIG. 11), the loading end position side region is the container rear side region Gv2, and the leveling work start position Ps is set in the container rear side region Gv2 (step S22 in FIG. 11).

Note that, in the flowchart illustrated in FIG. 11, when the loading end position Ee is at the boundary between the container front side region Gv1 and the container rear side region Gv2 illustrated in FIG. 9, the controller 50 determines NO in step S20 of FIG. 11. In this case, the leveling work start position Ps illustrated in FIG. 9 is set in the container rear side region Gv2 (step S22 in FIG. 11). However, when the loading end position Ee exists at the boundary between the container front side region Gv1 and the container rear side region Gv2, the leveling work start position Ps may be set in the container front side region Gv1.

[Example 3B] For example, the leveling work start position Ps may be set in a region including the loading end position Ee out of two regions obtained by dividing the internal region of the container 13 when viewed from above into two equal parts in the container width direction W that is a direction orthogonal to the longitudinal direction of the container 13. Specifically, for example, two regions obtained by dividing the internal region of the container 13 when viewed from above into two equal parts in the container width direction W include a container left side region Gw1 which is a region located in the container leftward direction W1 and a container right side region Gw2 which is a region located in the container rightward direction W2. In a case where the loading end position Ee is included in the container left side region Gw1, the loading end position side region is the container left side region Gw1, and the leveling work start position Ps is set in the container left side region Gw1. In a case where the loading end position Ee is included in the container right side region Gw2, the loading end position side region is the container right side region Gw2, and the leveling work start position Ps is set in the container right side region Gw2.

Note that [Example 3A] above and [Example 3B] above may be combined. Specifically, for example, in a case where the loading end position Ee is included in the container rear side region Gv2 and included in the container left side region Gw1, the loading end position side region may be an overlapping region in which the container rear side region Gv2 and the container left side region Gw1 overlap, and the leveling work start position Ps may be set in the overlapping region, that is, in the container rear side region Gv2 and in the container left side region Gw1. In the case of a combination of other regions, the leveling work start position Ps is similarly set.

(Distance of Work Start Position Ps from End of Container 13)

The controller 50 preferably controls the position of the bucket 25*c*, that is, sets the target path P of the leveling work so that the contact between the container 13 (for example, the container wall surface 13*b*) and the bucket 25*c* can be suppressed when the leveling work is performed. The target path P of the leveling work is, for example, a path from the target position P1 to the target position P6 indicated by a plurality of arrows in the specific example illustrated in FIG. 12.

The leveling work start position Ps is preferably set so that contact between the container 13 (the container wall surface 13*b*) and the bucket 25*c* can be suppressed when the bucket 25*c* is arranged at the leveling work start position Ps. The distance in the horizontal direction (horizontal distance) between the bucket 25*c* arranged at the leveling work start position Ps and the container wall surface 13*b* can be variously set. The horizontal distance may be manually set by the worker, or may be automatically set by the controller 50 (more specifically, the work plan setting unit 53).

(Position and Order of Leveling Work)

Hereinafter, a case where the controller 50 causes the work machine 20 to perform a plurality of leveling operations in the leveling work will be mainly described. In this case, the leveling work includes a plurality of leveling operations. Among the plurality of leveling operations, the start position Ps of the first leveling operation is the start position of the leveling work, that is, the leveling work start position Ps. The start position of the second and subsequent leveling operations among the plurality of leveling operations can be variously set. Note that, hereinafter, the start position of the second and subsequent leveling operations in the leveling work is referred to as a leveling work position.

For example, the leveling work position of the next leveling operation may be set to a position shifted in a preset specific direction from the start position of the previous leveling operation. The specific direction may be, for example, the container forward/rearward direction V or the container width direction W. For example, the leveling work position of the second leveling operation may be set in a region not including the loading end position Ee out of the two regions. For example, the plurality of leveling work positions may be set so as to be shifted in order from a position close to one end portion of the container 13 in the other end portion of the container 13.

In a case where the loading end position Ee is included in the container rear side region Gv2, the second and subsequent leveling work positions may be set so as to be gradually shifted in the container forward direction V1 with respect to the start position of the first leveling operation (leveling work start position Ps). [Example 4A] In addition, the leveling operation may be performed in the entire (or approximately the entire) container width direction W at a position close to the end portion in the container rearward direction V2 of the container 13, and then the leveling operation may be performed in the entire (or approximately the entire) container width direction W at a position shifted in the container forward direction V1. [Example 4B] In addition, the plurality of leveling work positions may be set so as to be gradually shifted in the container forward direction V1 from a position close to the end portion in the container rearward direction V2 of the container 13 to a position close to the end portion in the container forward direction V1 of the container 13 without changing the position in the container width direction W. Thereafter, another plurality of leveling work positions may be set at positions shifted in the container width direction W with respect to the plurality of leveling work positions. The another plurality of leveling work positions may be set so as to be gradually shifted in the container forward direction V1 from a position close to the end portion in the container rearward direction V2 of the container 13 to a position close to the end portion in the container forward direction V1 of the container 13 without changing the position in the container width direction W. Note that the direction in which the leveling work position is shifted may be the container forward direction V1 instead of the container rearward direction V2.

Note that the direction in which the leveling work position is shifted does not have to be the specific direction, and may be various directions.

(Press-Leveling)

For example, in the leveling work, the controller 50 causes the bucket 25*c* to perform a press-leveling operation of pressing the work target object A illustrated in FIG. 8 in the downward direction Z2. The press-leveling operation is an operation in which a part of the bucket 25*c* (specifically, for example, the bucket distal end back surface 25*c*2) pushes the work target object A in the container 13 in the downward direction Z2. For example, in the leveling work, the controller 50 causes the bucket 25*c* to perform a plurality of press-leveling operations while changing the position of the press-leveling operation as illustrated in FIG. 12, for example. The bucket 25*c* levels the work target object A in the press-leveling range Q illustrated in FIG. 12 in each press-leveling operation to thereby level or approximately level the work target object A in the press-leveling range Q.

The press-leveling range Q is a range in which the bucket 25*c* presses and levels the work target object A in one press-leveling operation when the container 13 and the work target object A are viewed from above. The press-leveling range Q is a range of the work target object A immediately below the bucket 25*c* to be pressed/leveled. That is, the press-leveling range Q is a range of the work target object A lower in the downward direction Z2 than the bucket 25*c* and facing the bucket 25*c* in the upward/downward direction Z.

(Lap Portion Q1)

When the bucket 25*c* performs the press-leveling operation of leveling the work target object A, a part of the work target object A is pushed out to the periphery of the press-leveling range Q and protrudes from the range. More specifically, the upper surface of the work target object A around the press-leveling range Q becomes higher than the upper surface of the work target object A in the press-leveling range Q. In this case, another press-leveling operation is preferably performed so as to level the work target object A pushed out around the press-leveling range Q.

Specifically, for example, the controller 50 changes the press-leveling ranges Q so that adjacent press-leveling ranges Q partially overlap each other. Thus, a lap portion Q1 in which a part of the press-leveling range Q and a part of the press-leveling range Q adjacent thereto overlap with each other is formed.

The direction in which the two adjacent press-leveling ranges Q are arranged may be the container forward/rearward direction V, the container width direction W, the machine slewing direction Sw, or the machine forward/rearward direction X. In the example illustrated in FIG. 12, the direction in which two adjacent press-leveling ranges Q are arranged is the container forward/rearward direction V or the container width direction W. More specifically, a press-leveling range Qp1 when the bucket 25*c* performs the press-leveling operation at the place corresponding to the position P1 and a press-leveling range Qp2 when the bucket 25*c* performs the press-leveling operation at the place corresponding to the position P2 are arranged in the container width direction W, and an end portion of the press-leveling range Qp1 and an end portion of the press-leveling range Qp2 overlap each other. Further, the press-leveling range Qp1 and a press-leveling range Qp3 when the bucket 25*c* performs the press-leveling operation at the place corresponding to the position P3 are arranged in the container forward/rearward direction V, and an end portion of the press-leveling range Qp1 and an end portion of the press-leveling range Qp3 overlap each other.

Figure 13:
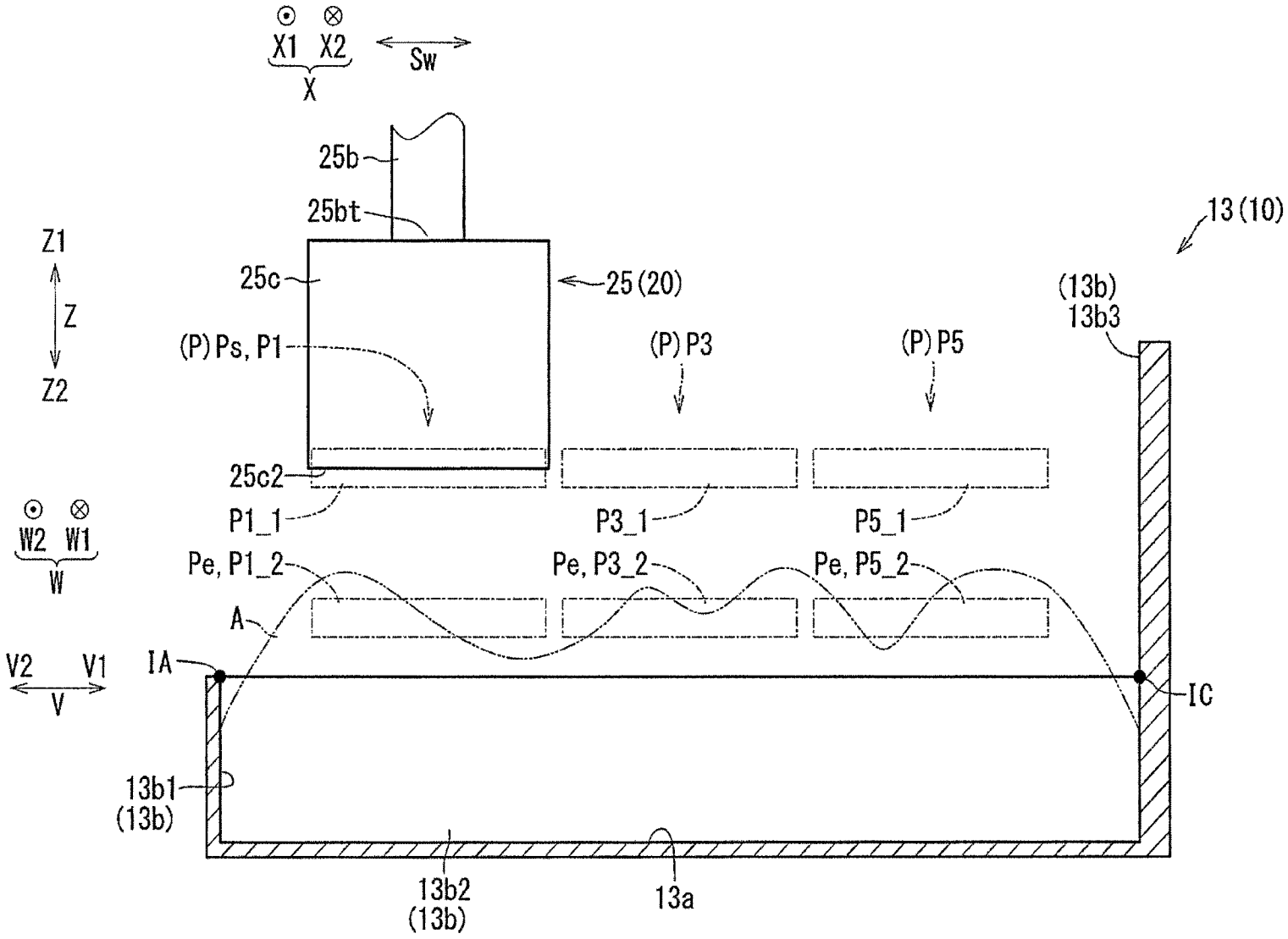
FIG. 13 is a cross-sectional view taken along line F6-F6 in FIG. 12.

The width of the lap portion Q1 (the amount of overlap) may be set by manual operation of the worker (for example, input of information to the operation unit 41 by the worker), or may be automatically set by the controller 50 (the work plan setting unit 53). For example, the width of the lap portion Q1 may be set on the basis of the shape of the work target object A around the press-leveling range Q detected by the work target object detector 34, that is, the shape of the work target object A pushed out around the press-leveling range Q. Note that, unlike the specific example illustrated in FIG. 12, the specific example illustrated in FIG. 13 illustrates a case where two adjacent press-leveling ranges do not overlap each other and the above-described lap portion Q1 is not formed.

(Sinking and Press-Leveling End Position Pe of Container 13)

As illustrated in FIG. 8, in the case where the container 13 is a cargo bed of the vehicle 10, the container 13 is pushed by the bucket 25*c* via the work target object A and moves in the downward direction Z2 so as to approach the ground. In other words, when the bucket 25*c* pushes the work target object A in the downward direction Z2, the container 13 sinks so as to approach the ground. For example, when the bucket 25*c* further presses and levels the work target object A in a state where the work target object A is already leveled, the work machine 20 performs an unnecessary press-leveling operation. Further, when the bucket 25*c* presses down the work target object A too much, the vehicle 10 may be damaged. Accordingly, in order to enable suppression of the occurrence of these problems, a press-leveling end position Pe illustrated in FIG. 13 is preferably set. The "press-leveling end position Pe" is a position of the bucket 25*c* when one press-leveling operation is ended.

[Example 5A] The press-leveling end position Pe may be set on the basis of a decrease amount (sinking amount) of the height of the container 13 with respect to the ground. More specifically, when the sinking amount of the container 13 (the cargo bed of the vehicle 10 in the present embodiment) detected by the sinking amount detector 36 exceeds the predetermined sinking amount threshold, the controller 50 may cause the bucket 25*c* to finish one press-leveling.

Here, [Example 5A] above is compared with a case where the press-leveling end position Pe is set on the basis of the load acting on the bucket 25*c* (see [Example 5B] described later). It is assumed that the load acting on the bucket 25*c* increases (greatly changes) after the container 13 sinks greatly. However, when the load acting on the bucket 25*c* increases, the container 13 already sinks greatly, and the bucket 25*c* may already be in a state of pressing down the work target object A too much. On the other hand, when the press-leveling end position Pe is set on the basis of the sinking amount of the container 13, it is possible to more effectively suppress the bucket 25*c* from pressing down the work target object A too much.

[Example 5B] The press-leveling end position Pe may be set on the basis of the load acting on the bucket 25*c*. The load acting on the bucket 25*c* may be detected by the in-bucket mass detector 35. The load acting on the bucket 25*c* may be detected on the basis of, for example, loading (for example, hydraulic pressure) acting on the bucket cylinder that rotates the bucket 25*c* with respect to the arm 25*b*. In addition, the load acting on the bucket 25*c* may be detected on the basis of a load acting on a link connecting the arm 25*b*, the bucket 25*c*, and the bucket cylinder.

[Example 5C] The press-leveling end position Pe may be set on the basis of the information of the work target object A detected by the work target object detector 34 (for example, the shape of the work target object A). For example, the press-leveling end position Pe may be set on the basis of the height (position in the upward/downward direction Z) of the upper surface (surface) of the work target object A. [Example 5D] The press-leveling end position Pe may be set on the basis of information (for example, the position of the container 13, the shape of the container 13, and the like) of the container 13 detected by the container detector 33. For example, the press-leveling end position Pe may be set on the basis of the height of the container 13, for example, may be set on the basis of the height of the container wall surface 13*b* (for example, the tail gate plate surface 13*b*1 or the side gate panel surface 13*b*2). The press-leveling end position Pe may be set on the basis of the height of the container floor surface 13*a*. [Example SE] The press-leveling end position Pe may be set by manual operation of the worker (for example, input of information to the operation unit 41 by the worker).

(Horizontal Pull-Leveling, or the Like)

The leveling work may not be performed by the press-leveling operation. For example, the leveling work may include a horizontal pull-leveling operation which is an operation of leveling the work target object A by moving the bucket 25*c* in the horizontal direction in a state where the bucket 25*c* illustrated in FIG. 8 is in contact with the work target object A. The moving direction of the bucket 25*c* in the horizontal pull-leveling operation may be the container forward/rearward direction V, the container width direction W, the machine slewing direction Sw (see FIG. 9), the machine forward/rearward direction X, or a direction including components in two or more directions of these directions.

Calculation Example of Coordinates

A case where the leveling work includes a plurality of press-leveling operations and the press-leveling range Q is sequentially changed in the internal region of the container 13 will be described. The controller 50 (work plan setting unit 53) calculates the target path P of the bucket 25*c*. The target path P includes a plurality of target positions and information of the order of the target positions. The plurality of target positions of the target path P includes a position P1, a position P2, . . . , a position Pn. Numerals of the plurality of positions P1 to Pn indicate the order in which the bucket 25*c* performs the press-leveling operation. The "position Pn" is the last target position in the target path P, and is the position P6 in the example illustrated in FIG. 12. Two adjacent target positions among the plurality of target positions P1 to Pn are shifted from each other in at least one of the container width direction W and the container forward/rearward direction V. The first target position P1 among the plurality of target positions P1 is set, for example, at a position close to the end portion in the container rearward direction V2 in the internal region of the container 13, and the last target position Pn among the plurality of target positions P1 is set, for example, at a position close to the end portion in the container forward direction V1 in the internal region of the container 13.

The press-leveling operation is performed at a location corresponding to each of the plurality of target positions P1 to Pn. The controller 50 sets a raised position and a lowered position in each press-leveling operation. For example, as illustrated in FIG. 13, the controller 50 sets a raised position P1_1 and a lowered position P1_2 for the press-leveling operation performed at the place corresponding to the position P1. Similarly, the controller 50 sets a raised position and a lowered position for the press-leveling operation performed at the place corresponding to each of the positions P2 to Pn. The raised position P1_1 in the press-leveling operation performed at the place corresponding to the first target position P1 is the leveling work start position Ps.

The raised position in each press-leveling operation is the position of the bucket 25*c* before the bucket 25*c* performs the press-leveling operation (raised position before leveling). In the present embodiment, the raised position in each press-leveling operation may be a position (raised position after leveling) at which the bucket 25*c* moves in the upward direction Z1 after the bucket 25*c* performs the press-leveling operation. Note that the raised position before leveling and the raised position after leveling are not necessarily the same, and may be different. In the present embodiment, the controller 50 controls the position of the bucket 25*c* so that the bucket distal end back surface 25*c*2 of the bucket 25*c* is arranged at the raised position at the start of each press-leveling operation, and controls the position of the bucket 25*c* so that the bucket distal end back surface 25*c*2 of the bucket 25*c* is arranged at the lowered position at the end of each press-leveling operation. FIG. 13 illustrates a state in which bucket distal end back surface 25*c*2 is arranged at the raised position P1_1 at the start of the first press-leveling operation.

The lowered position P1_2 is the position of the bucket 25*c* when the bucket 25*c* is arranged lowermost in the downward direction Z2 in the press-leveling operation at the place corresponding to the position P1, and is the press-leveling end position Pe. Similarly to the position P1, a raised position and a lowered position are also set for the press-leveling operation corresponding to each of the target positions P2 to Pn other than the position P1 illustrated in FIG. 12.

For example, the controller 50 stores each of the plurality of target positions P1 to Pn in coordinates in a preset coordinate system. Similarly, the controller 50 stores the position of the container 13 in coordinates in the coordinate system. The coordinate axes of the coordinate system may include, for example, an axis in the machine forward/rearward direction X, an axis in the upward/downward direction Z, and an axis in the machine slewing direction Sw, and in this case, the coordinates of each target position may include an X coordinate, a Z coordinate, and an Sw coordinate. The reference (origin) of the coordinate system may be, for example, the position of the attachment portion (boom foot pin) of the boom 25*a* to the upper slewing body 23 illustrated in FIG. 8, the slewing center of the upper slewing body 23 with respect to the lower travelling body 21, or other positions.

Before the controller 50 sets the plurality of target positions P1 to Pn illustrated in FIG. 12, the controller 50 acquires input data input from the detector, the imaging device 32, the operation unit 41, and the like. The input data may include, for example, position information of the container 13. For example, the position information of the container 13 may include information regarding a plurality of portions in the container 13. The information regarding the plurality of portions may include, for example, position information (specifically, three-dimensional coordinates) of an end point IA, an end point IB, an end point IC, and an end point ID illustrated in FIG. 12. For example, the end point IA is an upper end portion at a portion where the side gate panel surface 13*b*2 located in the container leftward direction W1 and the tail gate plate surface 13*b*1 intersect. For example, the end point IB is an upper end portion at a portion where the side gate panel surface 13*b*2 located in the container rightward direction W2 and the tail gate plate surface 13*b*1 intersect. For example, the end point IC is a portion where the side gate panel surface 13*b*2 and the guard frame surface 13*b*3 located in the container leftward direction W1 intersect, and is an upper end portion of the side gate panel surface 13*b*2. For example, the end point ID is a portion where the side gate panel surface 13*b*2 and the guard frame surface 13*b*3 located in the container rightward direction W2 intersect, and is an upper end portion of the side gate panel surface 13*b*2. The input data may include an adjustment value to be described later.

The controller 50 sets the target path P including the plurality of target positions P1 to Pn in the leveling work and the attitude of the attachment 25 at each target position on the basis of the input data. For example, the controller 50 may determine the plurality of target positions P1 to Pn included in the target path P using dimensions of the bucket 25*c* and dimensions of the internal region of the container 13. Specifically, these will be described as described below.

The controller 50 sets a position, an angle, and the like of a specific portion of the attachment 25 at each of the plurality of target positions P1 to Pn. Specifically, for example, the controller 50 may calculate an angle (slewing angle) of the machine slewing direction Sw of the upper slewing body 23 with respect to the lower travelling body 21 illustrated in FIG. 9 at each target position. The controller 50 may calculate a position of a specific portion (for example, the arm distal end portion 25*bt*) of the arm 25*b* at each target position. The controller 50 may calculate a bucket angle Xi illustrated in FIG. 8 at each target position. The bucket angle Xi may be an angle of the bucket 25*c* with respect to the vertical direction, an angle (ground angle) of the bucket 25*c* with respect to the horizontal direction, or an angle of the bucket 25*c* with respect to the arm 25*b*. In the example illustrated in FIG. 8, the bucket angle Xi is an angle of the bucket distal end back surface 25*c*2 with respect to the vertical direction. For example, the controller 50 may calculate a position of a specific portion (for example, the bucket distal end portion 25*ct*) of the bucket 25*c* at each target position. For example, the controller 50 may calculate coordinates of the bucket distal end portion 25*ct* and convert the coordinates into the coordinates of the arm distal end portion 25*bt* and the bucket angle Xi.

The controller 50 calculates the number n of times of press-leveling. The number n of times of press-leveling may be calculated on the basis of the dimensions of the container 13 illustrated in FIG. 12. The number n of times of press-leveling may be calculated on the basis of the dimensions of the bucket 25*c*. The number n of times of press-leveling may be calculated on the basis of a shift amount between adjacent press-leveling ranges Q. The shift amount is, for example, a distance between certain points (for example, central points) of adjacent press-leveling ranges Q in a predetermined shift direction. The predetermined shift direction may be the container forward/rearward direction V, the container width direction W, the machine slewing direction Sw, or the machine forward/rearward direction X. The shift amount may be calculated on the basis of manual operation of the worker (for example, input to the operation unit 41 by the worker), or may be automatically calculated by the controller 50. For example, the shift amount may be calculated on the basis of information (for example, dimensions) of the bucket 25*c* detected by the imaging device 32. The number n of times of press-leveling is preferably calculated so that the bucket 25*c* does not come into contact with the container 13 (more specifically, the container wall surface 13*b*).

Specifically, for example, when the number n of times of press-leveling is calculated on the basis of the dimensions of the container 13 and the shift amount (shift slewing angle) of the machine slewing direction Sw, the number n of times of press-leveling is calculated by the following expression.

$$n = \text{number of rows} \times (|\text{IB_sw} - \text{ID_sw}| - \text{first adjustment value}) / \text{shift slewing angle}$$

Here, in the above expression, the number of rows is the number of press-leveling ranges Q (the number of times of press-leveling) arranged in the container width direction W. In the example illustrated in FIG. 12, the number of rows is "2" (for example, two of the position P1 and the position P2). "IB_sw" is an angle (slewing angle) of the machine slewing direction Sw of the upper slewing body 23 when the attachment 25 illustrated in FIG. 9 faces the end point IB. Specifically, for example, "IB_sw" is an angle (slewing angle) of the machine slewing direction Sw of the upper slewing body 23 when the upper slewing body 23 is arranged at a position where a center line of the attachment 25 extending in the machine forward/rearward direction X passes through the end point IB when viewed from above. "ID_sw" is a slewing angle when the attachment 25 faces the end point ID. Specifically, for example, "ID_sw" is an angle (slewing angle) of the machine slewing direction Sw of the upper slewing body 23 when the upper slewing body 23 is arranged at a position where the center line of the attachment 25 passes through the end point ID when viewed from above. The first adjustment value is an adjustment value set to prevent the bucket 25*c* from contacting the container 13. The shift slewing angle is a shift amount between the press-leveling ranges Q adjacent to each other in the machine slewing direction Sw illustrated in FIG. 12.

(Coordinates of Raised Position P1_1)

Coordinates of the raised position P1_1 corresponding to the target position P1 illustrated in FIG. 13 are calculated as follows, for example. Note that, as described above, the raised position P1_1 before leveling and the raised position P1_1 after leveling may be the same or different. In addition, the calculation method of the coordinates of the raised position P1_1 may be the same or different between the raised position P1_1 before leveling and the raised position P1_1 after leveling. Hereinafter, the raised position P1_1 and the lowered position P1_2 will be described with reference to FIG. 13.

The X coordinate of the arm distal end portion 25*bt* illustrated in FIG. 12 at the raised position P1_1 is referred to as P1_1_*x*. For example, in the X coordinate, the machine forward direction X1 is set to a positive direction, and the machine rearward direction X2 is set to a negative direction. At this time, "P1_1_*x*" is calculated by the following expression.

$$P1_1_x = IA_x + (|IA_x - IB_x|) - \text{second adjustment value})/(\text{number of rows} + 1)$$

Here, in the above expression, "IA_x" is the X coordinate of the end point IA. "IB_x" is the X coordinate of the end point IB. The second adjustment value is an adjustment value set to prevent the bucket 25*c* from contacting the container 13. The "number of rows+1" is "3" when the number of rows is "2" as in the example illustrated in FIG. 12.

The Z coordinate of the arm distal end portion 25*bt* illustrated in FIG. 13 at the raised position P1_1 is referred to as P1_1_*z*. For example, in the Z coordinate, the upward direction Z1 is a positive direction, and the downward direction Z2 is a negative direction.

[Example 6A] "P1_1_*z*" may be set on the basis of the Z coordinate (P1_2_*z*) of the arm 25*b* at the lowered position P1_2. For example, "P1_1_*z*" of the raised position P1_1 before leveling may be calculated on the basis of "P1_2_*z*" determined even if press-leveling is not performed as described later, or may be calculated on the basis of "P1_2_*z*" determined after press-leveling is performed as described later. Similarly, "P1_1_*z*" of the raised position P1_1 after leveling may be calculated on the basis of "P1_2_*z*" determined even if press-leveling is not performed, or may be calculated on the basis of "P1_2_*z*" determined after press-leveling is performed.

"P1_1_*z*" is calculated by, for example, the following expression.

$$P1_1_z = P1_2_z + \text{third adjustment value}$$

Here, in the above expression, the third adjustment value is the height of the raised position P1_1 with respect to the lowered position P1_2. The third adjustment value may be set manually by the worker (for example, input to the operation unit 41 by the worker) or automatically by the controller 50. For example, the third adjustment value may be calculated on the basis of the height of the work target object A detected by the work target object detector 34.

[Example 6B] "P1_1_*z*" may be set without being based on "P1_2_*z*". For example, "P1_1_*z*" may be set to a value so that the bucket 25*c* arranged at the raised position P1_1 is arranged above the work target object A in the upward direction Z1. In this case, "P1_1_*z*" may be calculated on the basis of, for example, the height of the work target object A detected by the work target object detector 34.

The bucket angle Xi at the raised position P1_1 is represented by "P1_1_*xi*" (see FIG. 8 for the bucket angle Xi). The bucket angle P1_1_*xi* is set to a value suitable for the bucket 25*c* to press and level the work target object A. Specifically, for example, the bucket angle P1_1_*xi* is set to a value (specifically, 270 degrees or the like) so that the bucket distal end back surface 25*c*2 is parallel or approximately parallel to the horizontal direction.

The slewing angle (P1_1_*sw*) at the raised position P1_1 of the upper slewing body 23 illustrated in FIG. 9 is calculated by, for example, the following expression. Note that, in the machine slewing direction Sw, the left slewing direction is a positive direction, and the right slewing direction is a negative direction.

$$P1_1_sw = IB_sw - \text{fourth adjustment value}$$

Here, in the above expression, the fourth adjustment value is an adjustment value (specifically, 5 degrees or the like) set to prevent the bucket 25*c* from contacting the container 13. Note that "P1_1_*sw*" may be a value represented by "IA_sw—fourth adjustment value". "IA_sw" is a slewing angle of the upper slewing body 23 when the attachment 25 faces the end point IA. Specifically, for example, "IA_sw" is an angle (slewing angle) of the machine slewing direction Sw of the upper slewing body 23 when the upper slewing body 23 is arranged at a position where the center line of the attachment 25 extending in the machine forward/rearward direction X passes through the end point IA when viewed from above.

The coordinates of the raised position corresponding to each of the target positions P2 to Pn other than the position P1 illustrated in FIG. 12 are calculated by a calculation method (concept) similar to the calculation of the coordinates of the raised position P1_1 corresponding to the position P1.

(Coordinates of Lowered Position P1_2)

The lowered position P1_2 coordinate of the position P1 is calculated as follows, for example. The X coordinate (P1_2_*x*) of the arm distal end portion 25*bt* at the lowered position P1_2 is set to the same value as the X coordinate (P1_1_*x*) of the arm distal end portion 25*bt* at the raised position P1_1. The bucket angle Xi (see FIG. 8) and the slewing angle of the upper slewing body 23 at the lowered position P1_2 (see FIG. 9) are set to the same values as the bucket angle Xi and the slewing angle at the raised position P1_1.

The Z coordinate (P1_2_*z*) of the arm distal end portion 25*bt* illustrated in FIG. 13 at the lowered position P1_2 is calculated as follows. For a method of calculating "P1_2_*z*", two cases of a case where "P1_2_*z*" is determined without performing the press-leveling operation and a case where "P1_2_z" is determined after performing the press-leveling operation will be described.

[Example 7A] For example, in the cases of [Example 7A1] and [Example 7A2] below, "P1_2_z" is determined even if the press-leveling is not performed. [Example 7A1] "P1_2_z" may be set manually by the worker (for example, input to the operation unit 41 by the operator, teaching, and the like). [Example 7A2] "P1_2_z" may be set on the basis of the information of the container 13. Specifically, for example, "P1_2z" may be set on the basis of the height of the container floor surface 13*a*. "P1_2_z" may be set on the basis of the height of the side gate panel surface 13*b*2, may be set on the basis of the height of the tail gate plate surface 13*b*1, or may be set on the basis of the height of at least one of the end points IA, IB, IC, and ID. "P1_2_z" may be set on the basis of the information (for example, the shape of the work target object A, the height of the work target object A, and the like) of the work target object A before press-leveling. The information of the work target object A before press-leveling is detected by the work target object detector 34.

[Example 7B1] For example, a position where the sinking amount of the container 13 detected by the sinking amount detector 36 exceeds the predetermined sinking amount threshold may be "P1_2_z". In this case, "P1_2_z" is determined after the press-leveling operation is performed.

Coordinates of the lowered position at each of the target positions P2 to Pn other than the position P1 illustrated in FIG. 12 are calculated by a calculation method (concept) similar to the calculation of the coordinates of the lowered position P1_2 at the position P1.

(Coordinates of Position P2)

The position P2 illustrated in FIG. 12 is set to a position shifted from the position P1 by a predetermined shift amount in the container width direction W (the container rightward direction W2 in FIG. 12) or the machine forward/rearward direction X (the machine forward direction X1 in FIG. 12). For example, the Z coordinate and the bucket angle Xi (see FIG. 8) of the arm distal end portion 25*bt* at the position P2 may be set to the same values as the Z coordinate and the bucket angle Xi of the arm distal end portion 25*bt* at the position P1, or may be set to different values. The X-coordinate and the slewing angle of the arm distal end portion 25*bt* at the position P2 may be set so that the position P2 is shifted in the container width direction W by a predetermined shift amount with respect to the position P1. The X coordinate of the arm distal end portion 25*bt* at the position P2 may be set so that the position P2 is shifted in the machine forward/rearward direction X by a predetermined shift amount with respect to the position P1. In this case, the slewing angle at the position P2 may be equal to or different from the slewing angle at the position P1.

(Coordinates of Position P3)

The position P3 is set at a position shifted from the position P1 by a predetermined shift amount in the container forward/rearward direction V (the container forward direction V1 in FIG. 12) or the machine slewing direction Sw. Specifically, for example, the Z coordinate and the bucket angle Xi (see FIG. 8) of the arm distal end portion 25*bt* at the position P3 may be set to the same values as the Z coordinate and the bucket angle Xi of the arm distal end portion 25*bt* at the position P1, or may be set to different values). The X coordinate of the arm distal end portion 25*bt* at the position P3 may be set so that, for example, the position of the position P3 in the container width direction W and the position of the position P1 in the container width direction W are the same (or approximately the same). The X coordinate of the arm distal end portion 25*bt* at the position P3 may be the same as the X coordinate of the arm distal end portion 25*bt* at the position P1. The slewing angle (P3_*sw*) at the position P3 is calculated by, for example, the following expression.

$$P3_sw = P1_1_sw - \text{shifted slewing angle} = IB_sw - \text{fourth adjustment value} - \text{shifted slewing angle}$$

Coordinates of the target positions (positions P4, P5, and P6) other than the positions P1, P2, and P3 are calculated by a calculation method (concept) similar to that of the positions P1, P2, and P3. Note that the above coordinate calculation method is an example, and the coordinates may be calculated variously.

Summary of Second Embodiment

A configuration of the work system 1 according to the second embodiment illustrated in FIG. 8 and an effect obtained by the configuration are as follows.

The work system 1 according to the second embodiment is a system for automatically operating the work machine 20 including the attachment 25 (work device 25). The work system 1 includes the controller 50 that controls an operation of the work machine 20 so that a leveling work is performed, the leveling work including a leveling operation in which the work target object A that has been loaded into the container 13 by a loading work is leveled using the work device 25. The controller 50 acquires information regarding the loading work, and determines a start position of the leveling work using the information. The work device 25 includes the bucket 25*c*, the loading work is a work of loading the work target object A into the container 13 by using the bucket 25*c*, and the leveling work is a work of leveling the work target object A loaded into the container 13 by using the bucket 25*c*. The controller 50 controls the operation of the work machine 20 so that the loading work and the leveling work are performed. The information regarding the loading work includes information regarding a loading end position Ee which is a position of the bucket 25*c* at the end of the loading work. The leveling operation is a first leveling operation in the leveling work, and the start position is a leveling work start position Ps which is a start position of the first leveling operation. The controller 50 determines the leveling work start position Ps in a loading end position side region of an internal region of the container 13 when the container 13 is viewed from above. Therefore, the work system 1 can cause the work machine 20 to efficiently perform the leveling work by automatic operation. The loading end position side region may be a region including the loading end position Ee when the container 13 is viewed from above out of two regions obtained by dividing the internal region of the container 13 when the container 13 is viewed from above into two equal parts. The outline of the work system 1 according to the second embodiment is as described above.

Hereinafter, a specific configuration of the work system 1 according to the second embodiment and effects obtained thereby will be summarized.

The work system 1 includes the work machine 20 including the bucket 25*c*, and the controller 50 that causes the work machine 20 to automatically operate. The controller 50 causes the work machine 20 to perform the loading work and the leveling work. The loading work is a work of loading the work target object A into the container 13 by the bucket 25*c*. The leveling work is a work of leveling the work target object A loaded into the container 13 with the bucket 25*c* after the loading work is completed.

[Configuration 1] As illustrated in FIG. 9, a position where the bucket 25*c* is arranged at the end of the loading work is defined as a loading end position Ee. At this time, the controller 50 causes the work machine 20 to start the leveling work in the loading end position side region in the container 13.

According to [Configuration 1] above, it is possible to suppress the moving distance of the bucket 25*c* when the work of the work machine 20 by automatic operation is changed from the loading work to the leveling work. Thus, as compared with the case where the leveling work is not started in the loading end position side region, work efficiency of the work machine 20 when the work of the work machine 20 by automatic operation is changed from the loading work to the leveling work can be improved.

In the second embodiment, the container 13 may have a shape (for example, a rectangle) in which a dimension in a horizontal first direction is larger than a dimension in a horizontal second direction orthogonal to the first direction, and the two regions may be obtained by dividing the internal region of the container 13 into two equal parts in the first direction.

[Configuration 2] Specifically, as illustrated in FIG. 9, the container 13 has a shape having a longitudinal direction when viewed from above. The controller 50 causes the work machine 20 to start leveling work in a loading end position side region in the longitudinal direction (container forward/rearward direction V) of the container 13.

The following effects can be obtained by [Configuration 2] above. Consideration will be given to a case where the leveling work is started not from the loading end position side region in the container forward/rearward direction V but from the region on the opposite side. In this case, the moving distance of the bucket 25*c* from the loading end position Ee to the leveling work start position Ps (the start position of the leveling work) can be at most approximately the distance from one end to the other end of the container 13 in the container forward/rearward direction V. On the other hand, when the leveling work is started from the loading end position side region in the container forward/rearward direction V, the moving distance of the bucket 25*c* from the loading end position Ee to the leveling work start position Ps is at most approximately within the distance from one end to the other end of the container 13 in the container width direction W or within a half distance of the length of the container 13 in the container forward/rearward direction V. Thus, the moving distance of the bucket 25*e* when the automatic operation of the work machine 20 is changed from the loading work to the leveling work can be further suppressed. Therefore, the work efficiency by automatic operation of the work machine 20 can be further improved.

In addition, in the second embodiment, the leveling work includes the first leveling operation and the last leveling operation of leveling the work target object A using the bucket 25*c*, and the controller 50 may control the operation of the work machine 20 so that the last leveling operation is performed in a region not including the loading end position Ee out of the two regions. [Configuration 3] Specifically, for example, the controller 50 may cause the work machine 20 to perform the leveling work in order from the loading end position side region in the internal region of the container 13 when viewed from above toward a region opposite to the loading end position side region in the internal region of the container 13 when viewed from above.

In [Configuration 3] above, the moving distance of the bucket 25*c* can be suppressed as compared with the case where the leveling work is randomly performed in the internal region of the container 13 when viewed from above. Thus, the work efficiency by automatic operation of the work machine 20 can be further improved.

In addition, in the second embodiment, the first leveling operation is a first press-leveling operation of pressing the work target object A in the container 13 downward using the bucket 25*c* in a first press-leveling range, the leveling work further includes a second press-leveling operation of pressing the work target object A in the container 13 downward using the bucket 25*c* in a second press-leveling range, and the controller 50 may control the operation of the work machine 20 so that a part of the second press-leveling range overlaps the first press-leveling range when viewed from above.

Specifically, the controller 50 causes the bucket 25*c* to perform the press-leveling operation of pressing the work target object A in the downward direction Z2 a plurality of times as the leveling work. As illustrated in FIG. 12, the range in which the bucket 25*c* presses and levels the work target object A in one press-leveling operation when viewed from above is referred to as a press-leveling range Q as described above.

[Configuration 4] The controller 50 causes the work machine 20 to perform the leveling work while shifting the press-leveling range Q so that adjacent press-leveling ranges Q partially overlap each other (so that the lap portion Q1 is provided).

According to [Configuration 4] above, even when the work target object A is pushed out around the bucket 25*c* by the press-leveling, the bucket 25*c* can press and level the pushed-out work target object A. Thus, the work target object A can be leveled flat as compared with the case of not including [Configuration 4] above.

Further, in the second embodiment, in the case where the container 13 is a cargo bed of the vehicle 10, the information regarding the state of the container 13 includes information regarding a decrease amount (sinking amount) of the height of the cargo bed with respect to the ground, the leveling operation is a press-leveling operation of pressing the work target object A in the container 13 downward using the bucket 25*c*, and the controller 50 may control the operation of the work machine 20 so that the press-leveling operation stops when the decrease amount (sinking amount) exceeds a predetermined value during the press-leveling operation.

Specifically, as illustrated in FIG. 10, the work system 1 includes a sinking amount detector 36. The sinking amount detector 36 detects a decrease amount (sinking amount) of the height of the cargo bed of the vehicle 10 as the container 13 illustrated in FIG. 13 with respect to the ground. As the leveling work, the controller 50 causes the bucket 25*c* to perform a press-leveling operation of pressing the work target object A in the downward direction Z2.

[Configuration 5] When the sinking amount of the container 13 (cargo bed) detected by the sinking amount detector 36 exceeds the predetermined sinking amount threshold, the controller 50 causes the bucket 25*c* to stop the press-leveling operation (see the description of the press-leveling end position Pe).

The following effects can be obtained by [Configuration 5] above. In a state where the container 13 as a cargo bed sinks greatly, it is assumed that the work target object A is already leveled. Even if the bucket 25*c* further presses down the work target object A in this state, the work machine 20 performs unnecessary work, and the vehicle 10 including the container 13 may be damaged. Therefore, according to [Configuration 5] above, it is possible to suppress unnecessary pressing of the work target object A by the bucket 25*c*. Thus, the work efficiency of the work machine 20 can be further improved. Further, according to [Configuration 5] above, it is possible to suppress the damage of the vehicle 10 including the container 13 (cargo bed).

Modifications

The above embodiment may be variously modified. For example, the number of components of the above embodiment may be changed, and some of the components do not have to be provided. For example, the connection of the components illustrated in FIG. 10 or the like may be changed. For example, a plurality of members and parts different from each other may be described as one member and part. For example, what has been described as one member and part may be divided into a plurality of different members and parts. Specifically, for example, the components (the work plan setting unit 53, the automatic operation control unit 59, and the like) of the controller 50 may be separately provided. For example, various parameters (setting value, threshold, range, and the like) may be preset in the controller 50, or may be directly set by manual operation of the worker (for example, operation of the operation unit 41, teaching, or the like). Various parameters may be calculated by the controller 50 on the basis of information set by manual operation of the worker, or may be calculated by the controller 50 on the basis of information detected by the detection unit 30. For example, the various parameters may not be changed, may be changed by manual operation, or may be automatically changed by the controller 50 according to some condition. For example, some of the steps of the flowchart illustrated in FIG. 11 may not be performed. For example, the components each may have only some of features (function, arrangement, shape, manufacturing method, operation, and the like).

The invention claimed is:

1. A work system for automatically operating a work machine including a work device, the work system comprising:

a controller that controls an operation of the work machine so that a leveling work is performed, the leveling work including a leveling operation in which a work target object that has been loaded into a container by a loading work is leveled using the work device, wherein the controller acquires information regarding at least one of the work target object in the container, the container, the work machine, and the loading work, and determines at least one of a start position of the leveling operation and an end position of the leveling operation by using the information, wherein the work device includes a bucket, wherein the loading work is a work of loading the work target object into the container by using the bucket, and the leveling work is a work of leveling the work target object loaded into the container by using the bucket, wherein the controller controls an operation of the work machine so that the loading work and the leveling work are performed, wherein the information regarding the loading work includes information regarding a loading end position which is a position of the bucket at an end of the loading work, wherein the leveling operation is a first leveling operation in the leveling work, wherein the start position is a leveling work start position which is a start position of the first leveling operation, and wherein the controller determines the leveling work start position in a loading end position side region of an internal region of the container when the container is viewed from above.

2. The work system according to claim 1, comprising the work machine.

3. The work system according to claim 1, wherein the loading end position side region is a region including the loading end position when the container is viewed from above out of two regions obtained by dividing the internal region of the container when the container is viewed from above into two equal parts.

4. The work system according to claim 3, wherein the container has a shape in which a dimension in a horizontal first direction is larger than a dimension in a horizontal second direction orthogonal to the first direction, and the two regions are obtained by dividing the internal region into two equal parts in the first direction.

5. The work system according to claim 3, wherein the leveling work further includes a last leveling operation of leveling the work target object using the bucket, and the controller controls the operation of the work machine so that the last leveling operation is performed in a region not including the loading end position out of the two regions.

6. The work system according to claim 1, wherein the first leveling operation is a first press-leveling operation of pressing the work target object in the container downward using the bucket in a first press-leveling range, the leveling work further includes a second press-leveling operation of pressing the work target object in the container downward using the bucket in a second press-leveling range, and the controller controls the operation of the work machine so that a part of the second press-leveling range overlaps the first press-leveling range when viewed from above.

7. The work system according to claim 1, wherein the container is a cargo bed of a vehicle, the information regarding the state of the container includes information regarding a decrease amount of a height of the cargo bed with respect to ground, the leveling operation is a press-leveling operation of pressing the work target object in the container downward using the bucket, and the controller controls the operation of the work machine so that the press-leveling operation stops when the decrease amount exceeds a predetermined value during the press-leveling operation.

* * * * *